US011298735B2

(12) United States Patent
Pearson et al.

(10) Patent No.: US 11,298,735 B2
(45) Date of Patent: Apr. 12, 2022

(54) MANUAL CONDUIT BENDER WITH ANGLE SETTER

(71) Applicant: Klein Tools, Inc., Lincolnshire, IL (US)

(72) Inventors: Daniel R. Pearson, Fort Worth, TX (US); Jordan L. Fisher, Arlington, TX (US)

(73) Assignee: Klein Tools, Inc., Lincolnshire, IL (US)

( * ) Notice: Subject to any disclaimer, the term of this patent is extended or adjusted under 35 U.S.C. 154(b) by 0 days.

(21) Appl. No.: 16/886,845

(22) Filed: May 29, 2020

(65) Prior Publication Data

US 2021/0031254 A1 Feb. 4, 2021

Related U.S. Application Data

(60) Provisional application No. 62/945,556, filed on Dec. 9, 2019, provisional application No. 62/882,365, filed on Aug. 2, 2019.

(51) Int. Cl.
*B21D 7/14* (2006.01)
*B21D 7/022* (2006.01)

(52) U.S. Cl.
CPC ..... *B21D 7/14* (2013.01); *B21D 7/022* (2013.01)

(58) Field of Classification Search
CPC . B21D 7/02; B21D 7/14; B21D 7/022; B21D 7/024; B21D 7/04; B21D 7/06; B21D 7/063; B21D 7/066
See application file for complete search history.

(56) References Cited

U.S. PATENT DOCUMENTS

| | | | | | |
|---|---|---|---|---|---|
| 2,847,705 | A * | 8/1958 | Hellwig | B21D 7/063 | 72/31.05 |
| 2,906,149 | A * | 9/1959 | Benfield | B21D 7/063 | 72/458 |
| 3,368,856 | A * | 2/1968 | Tisdall | A47B 87/02 | 312/111 |
| 4,052,881 | A * | 10/1977 | Mount | B21D 7/063 | 72/459 |
| 6,422,054 | B1 * | 7/2002 | White | B21D 7/02 | 72/458 |
| 6,834,527 | B2 * | 12/2004 | Hopwood | B21D 7/14 | 72/458 |
| 7,328,601 | B1 * | 2/2008 | King | B21D 7/063 | 72/31.05 |
| 7,624,607 | B2 * | 12/2009 | King | B21D 7/02 | 72/149 |
| 2015/0033813 | A1 * | 2/2015 | Leclerc | B21D 7/022 | 72/37 |

* cited by examiner

*Primary Examiner* — Adam J Eiseman
*Assistant Examiner* — Matthew Stephens

(57) ABSTRACT

A manual conduit bender includes an angle setter that can be selectively engaged with a bender head to allow users to precisely set common bend angles.

12 Claims, 21 Drawing Sheets

MANUAL CONDUIT BENDER WITH ANGLE SETTER

CROSS-REFERENCE TO RELATED APPLICATIONS

This application claims priority to provisional applications U.S. application No. 62/945,556 filed Dec. 9, 2019 and U.S. application No. 62/882,365 filed Aug. 2, 2019, both of which are incorporated by reference herein.

BACKGROUND OF THE DISCLOSURE

The present disclosure relates manual conduit benders, and more particularly, to such conduit benders that include structure that allows a user to repeatedly and easily achieve a desired bend by physically contacting the structure with a conduit while manually bending the conduit in the bender. While such conduit benders are known, they require the addition of multiple components and/or significant modifications to typical manual conduit benders, with some of the known benders risking that a conduit may be easily damaged by the additional structure during the bending operation.

BRIEF SUMMARY OF THE DISCLOSURE

In accordance with one aspect of this disclosure, a manual conduit bender includes a bender head and an angle setter. The bender head includes an arcuate channel configured to receive a length of conduit as it is being bent, the channel defined by opposed side wall joined by a base; and at least two pairs of grooves spaced along the channel, with one groove of each pair being formed in one of the sidewalls and the other groove of each pair being formed in the other of the sidewalls. The angle setter is selectively engagable in the channel at a plurality positions defined by the spaced pairs of grooves, with each position corresponding to a desired conduit bend angle. The angle setter includes a stop surface to engage a length of conduit as it is being bent; and a pair of ribs facing in opposite directions to releasably engage each pair of grooves to selectively locate the stop surface relative to each pair of grooves, each rib biased into engagement with the corresponding one of the grooves with the ribs engaged in one of the pair of grooves.

In one feature, each groove is defined by a concave, semicylindrical surface, and each rib is defined by a convex semicylindrical surface.

As one feature, the stop surface extends along a longitudinal axis and has a convex arcuate profile transverse to the longitudinal axis.

According to one feature, the bender head further includes at least one structural web underlying the arcuate channel, and the angle setter further includes an elongate channel configured to releasably receive a portion of the web to retain the angle setter in a stored position on the manual conduit bender.

In a further feature, the elongate channel extends along an axis that is coplanar with the longitudinal axis.

As one feature, the elongate channel and the stop surface are located on opposite faces of the angle setter.

In one feature, the bender head further includes at least one structural web underlying the arcuate channel, and the angle setter further includes an elongate channel configured to releasably receive a portion of the web to retain the angle setter in a stored position on the manual conduit bender.

According to one feature, the elongate channel is defined between two spaced walls with one of the ribs formed on one of the walls and the other rib formed on the other wall.

As one feature, each rib is formed on a side of the corresponding wall that faces away from the elongate channel.

In a further feature, the angle setter further includes a bottom surface that is shaped to conform to the arcuate channel, and each wall terminates at a surface that defines a portion of the bottom surface.

According to one feature, the angle setter further includes a bottom surface that is shaped to conform to the arcuate channel, the stop surface and the bottom surface located on opposite faces of the angle setter.

In one feature, the angle setter is sized so that no part of the angle setter extends outward from the arcuate channel with the bottom surface engaged against the arcuate channel and the ribs engaged in a pair of the grooves.

As one feature, the angle setter includes a one-piece, unitary body and the stop surface and the ribs are formed on the body.

According to one feature, each of the ribs includes a convex surface extending from a base to a terminal end.

In a further feature, the conduit bender further includes an elongate handle extending from the head.

As one feature, the head is a one-piece, unitary component and the handle is a separate component that is assembled to the head.

In accordance with one feature of this disclosure, a manual conduit bender includes a bender head and an angle setter. The bender head includes an arcuate channel configured to receive a length of conduit as it is being bent, the channel defined by opposed side wall joined by a base; and a first pair of grooves in the channel, one groove of the pair being formed in one of the sidewalls and the other groove of the pair being formed in the other of the sidewalls. The angle setter is selectively engagable in the channel at a position defined by the pair of grooves and corresponding to a desired conduit bend angle. The angle setter includes a stop surface to engage a length of conduit as it is being bent; and a pair of ribs facing in opposite directions to releasably engage each pair of grooves to selectively locate the stop surface relative to each pair of grooves, each rib biased into engagement with the corresponding one of the grooves with the ribs engaged in one of the pair of grooves.

According to one feature, the bender head includes at least two pairs of grooves spaced along the channel, with one groove of each pair being formed in one of the sidewalls and the other groove of each pair being formed in the other of the sidewalls. The first pair of grooves is one of the at least two pairs; and the angle setter is selectively engagable in the channel at a plurality positions defined by the spaced pairs of grooves, with each position corresponding to a desired conduit bend angle.

It should be understood that the inventive concepts disclosed herein do not require each of the features discussed above, may include any combination of the features discussed, and may include features not specifically discussed above.

DETAILED DESCRIPTION OF PREFERRED EMBODIMENTS

Figure 1:
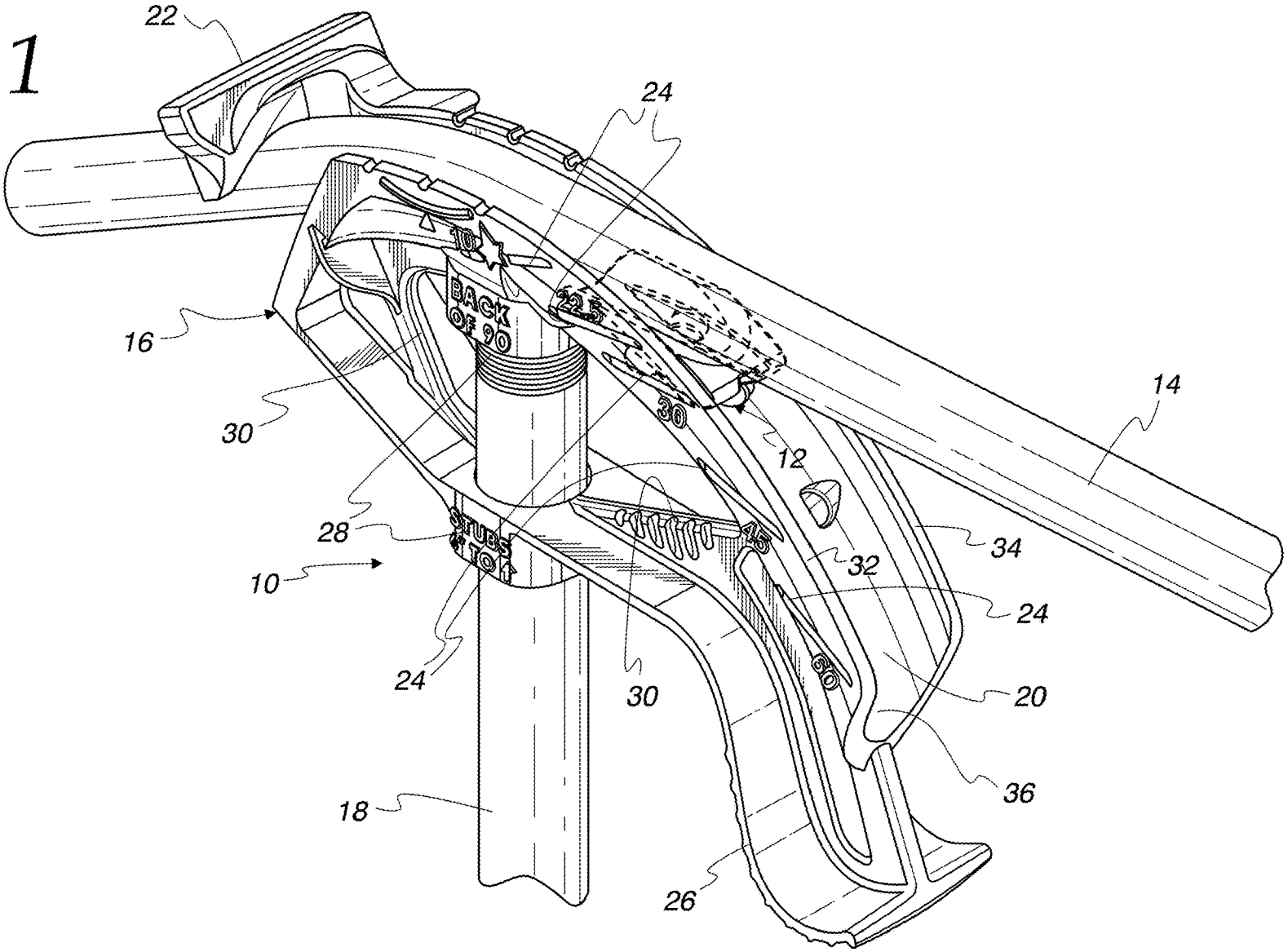
FIG. 1 is a perspective view from above and to the left of a manual conduit bender with an angle setter according to this disclosure, with a conduit shown in the bender and portions of the angle setter shown in phantom engaged at one position in the conduit bender.
Figure 2:
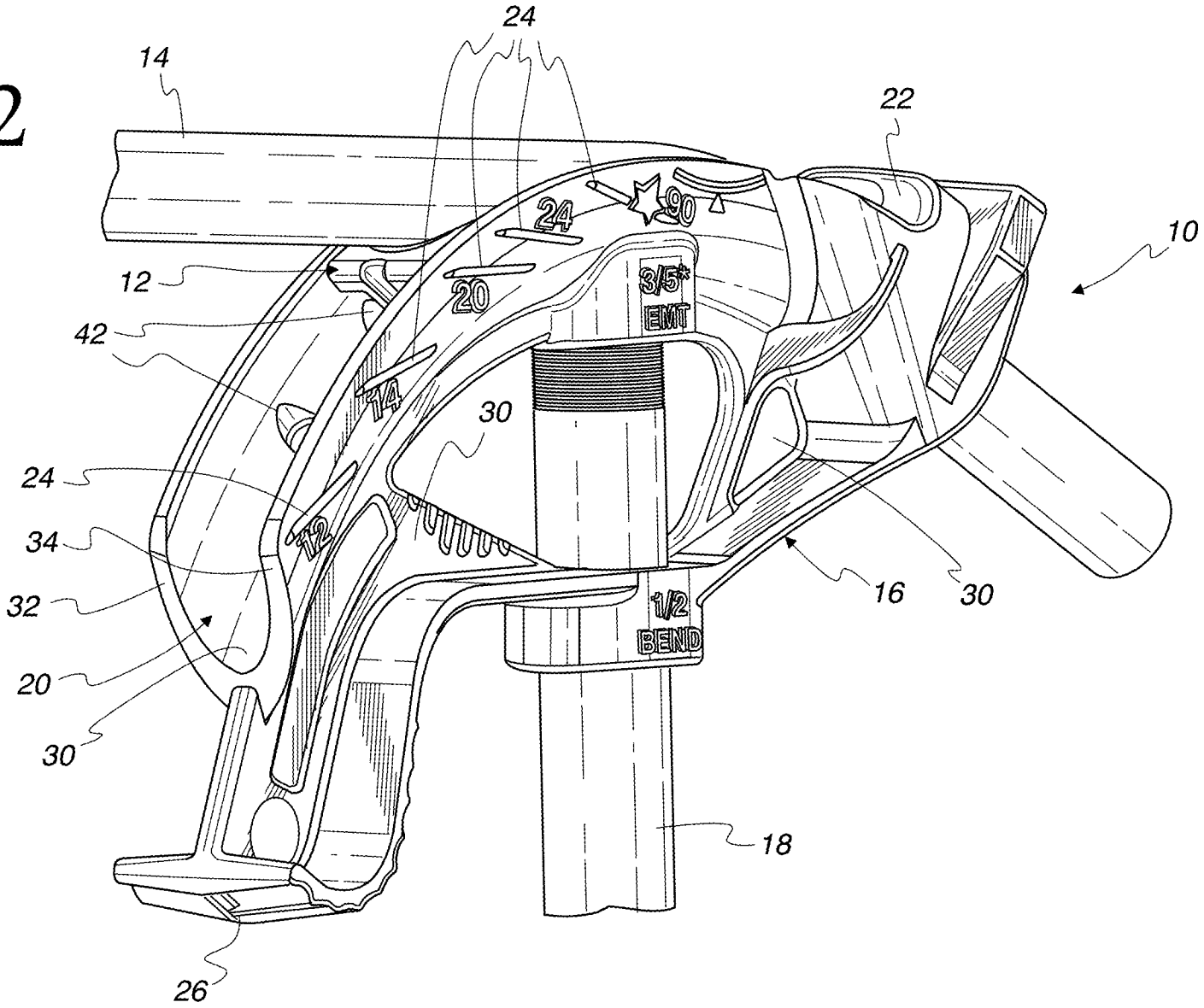
FIG. 2 is a view similar to FIG. 1, but shown from the right and slight lower viewing angle.
Figure 3:
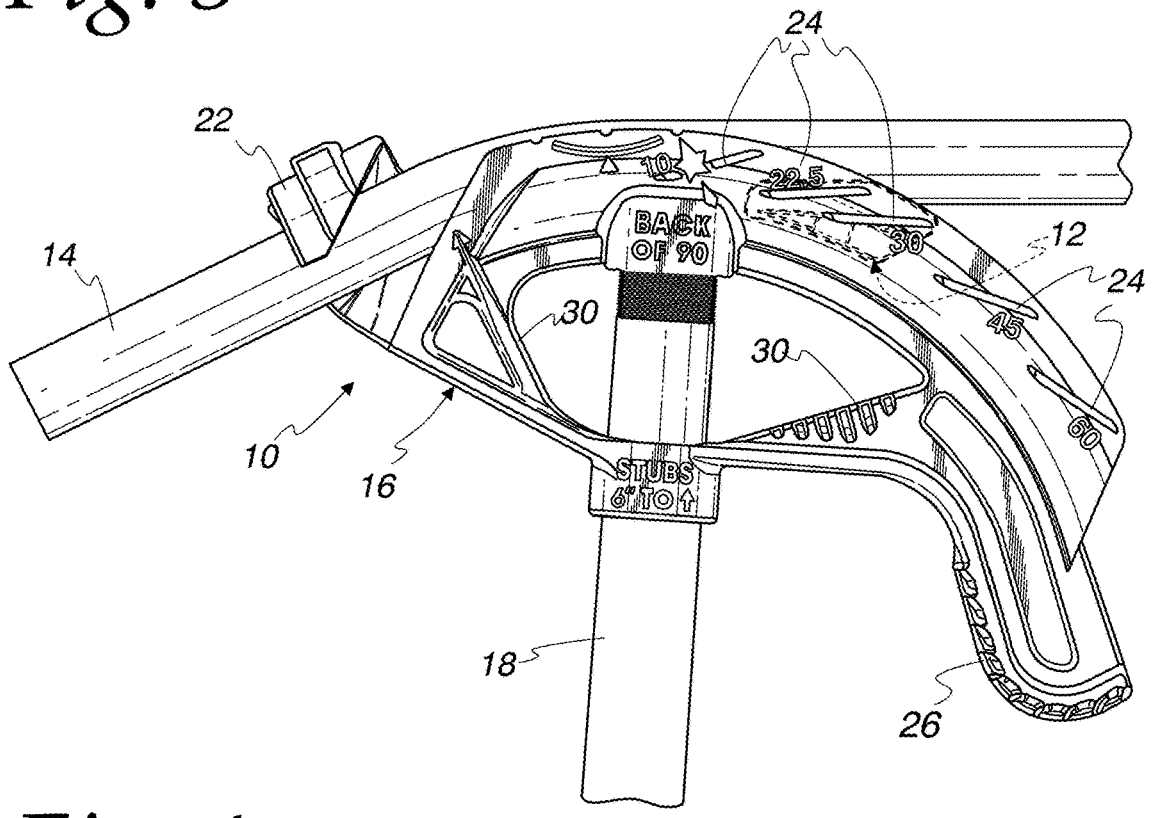
FIG. 3 is a side elevation of the manual conduit bender, angle setter, and conduit shown in FIGS. 1 and 2, with the angle setter shown in phantom.
Figure 4:
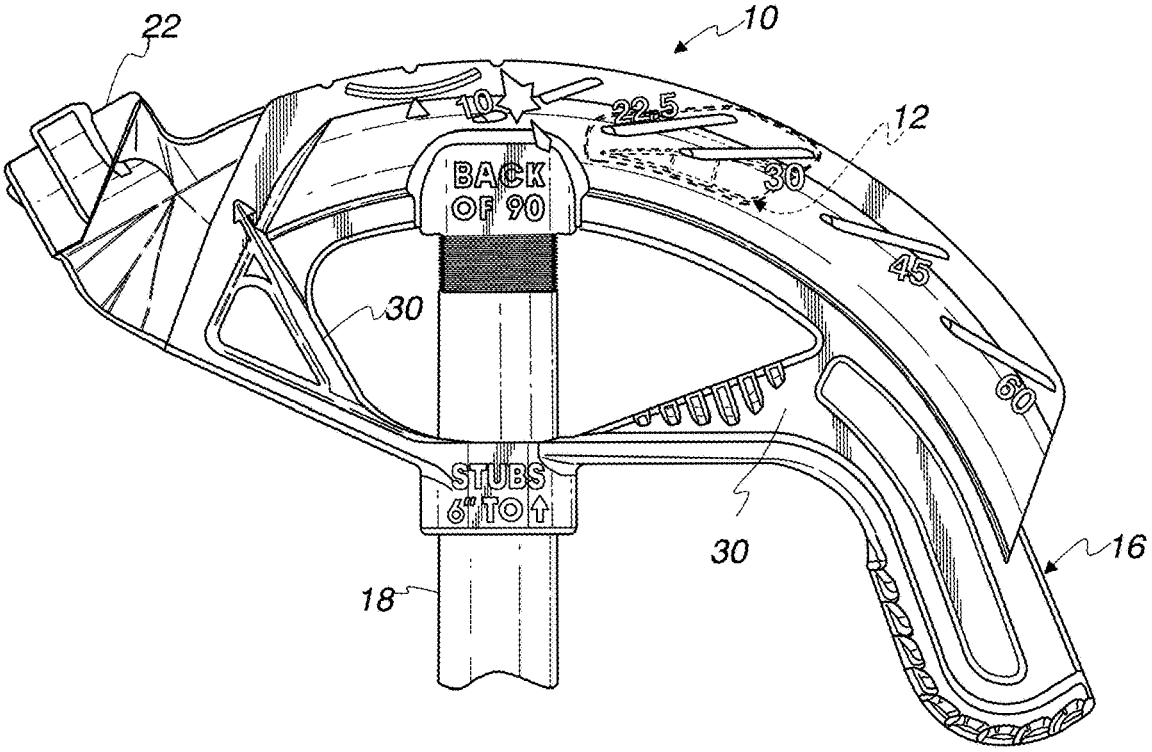
FIG. 4 is a view identical to FIG. 3, but with the conduit not shown.
Figure 5:
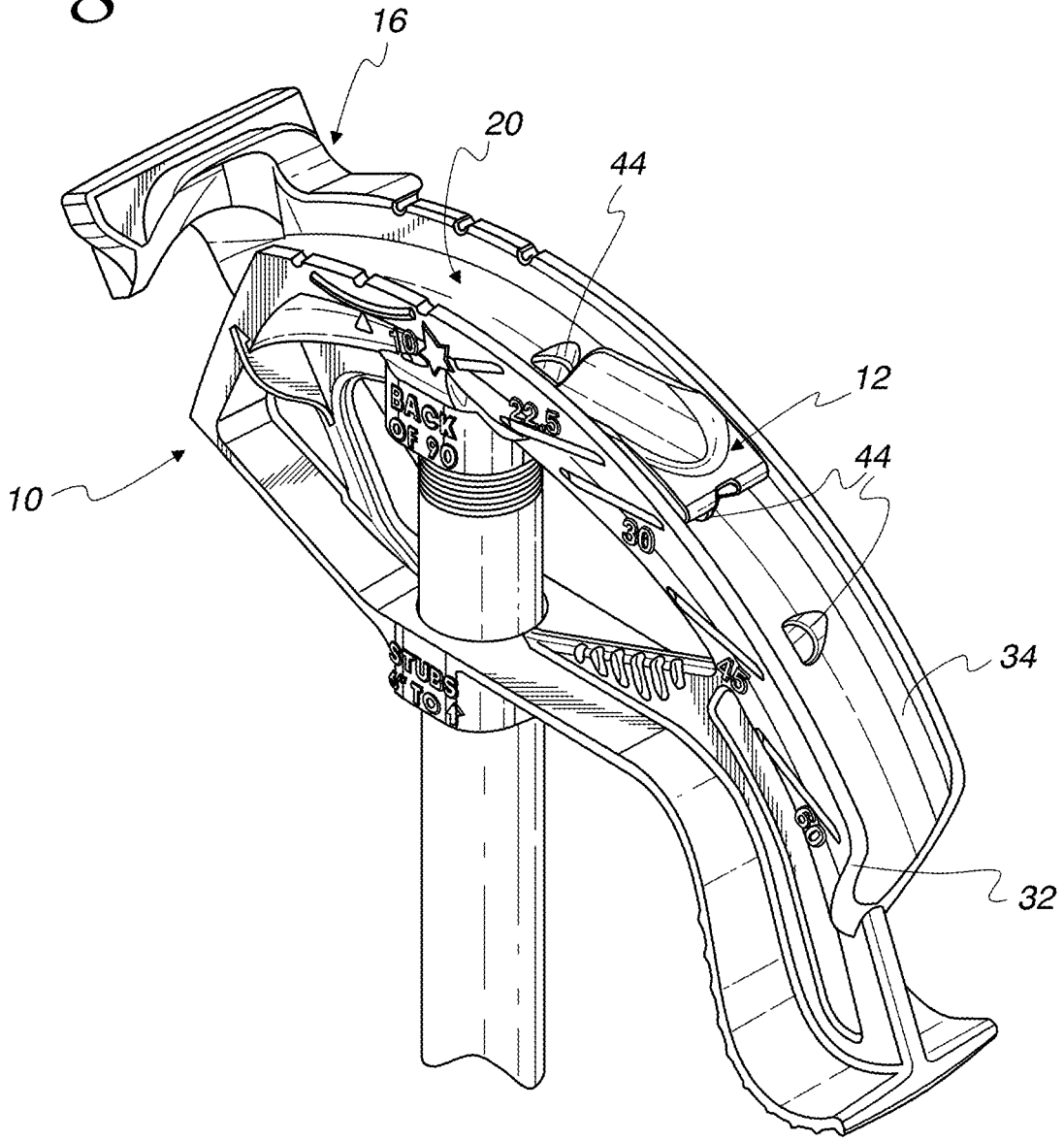
FIG. 5 is view identical to FIG. 1, but with the conduit not shown.

As best seen in FIGS. 1-4, a manual conduit bender 10 is shown in the attached figures with an angle setter 12 that can be selectively attached to the conduit bender 10 to allow users to precisely set the most common bend angles, make accurate and repeatable bends in a conduit 14, including from user to user, and reduce bending time thereby increasing efficiency while limiting the possibility that a conduit 14 will be damaged during the bending process.

The manual conduit bender 10 includes a bender head 16 and a handle 18. As is known and typical for manual benders, the bender head 16 is a unitary, one-piece component (i.e., made from a single piece of material), and includes an arcuate channel 20 configured to receive a length of conduit 14 and apply a bending force to the conduit 14 as the conduit 14 is being bent, a conduit hook/grip 22 configured to hold a conduit 14 and apply an opposing bending force as the conduit 14 is being bent, visual bend angle indicators 24 to provide users a visual indication of when particular bend angles have been achieved during a bending operation, a foot lever 26 to allow a user's foot to apply a bending force to the conduit bender 10 during bending process, a handle mount/attachment structure 28 for attaching the handle 18 to the bender hear 16, and structural webs 30 for providing structural support and the transferal of bending forces from the handle 18 and foot lever 26 to the channel 20 and the hook/grip 22 during the bending process. As is typical, the channel 20 is defined by opposed sidewalls 32 and 34 joined by a base 36, with a semi-circular cross-sectional profile that conforms, at least somewhat, to the cylindrical shape of the conduit 14. The above features of the conduit bender 10 can be provided in any suitable form, many of which are known and commercially available, and the details of these feature are not critical to an understanding of the inventive concepts disclosed herein.

Figure 7:
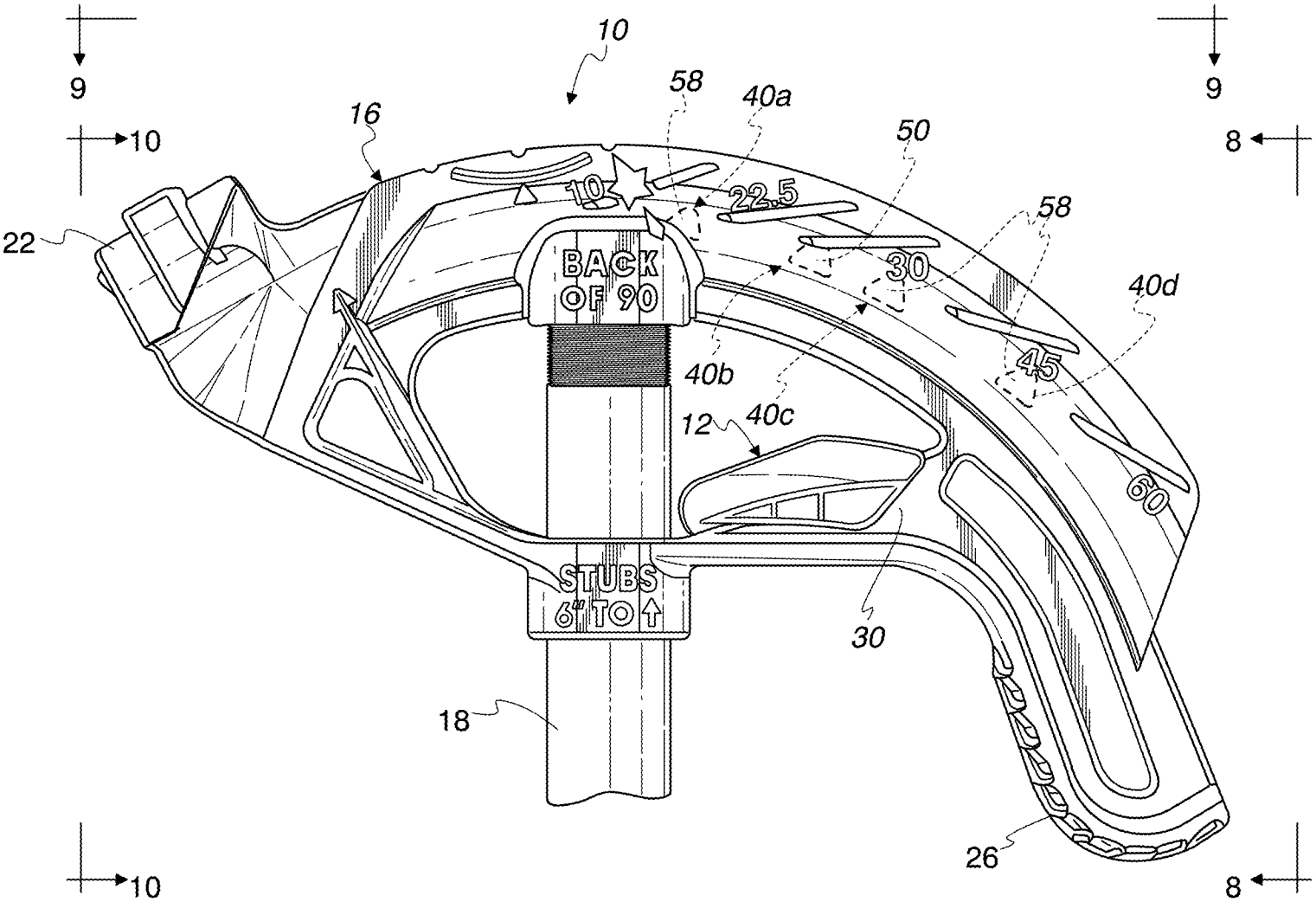
FIG. 7 is a view identical to FIG. 4, but with the conduit not shown, the angle setter shown in the stored position on the conduit bender, and with selected features of the conduit bender shown in phantom.
Figure 8:
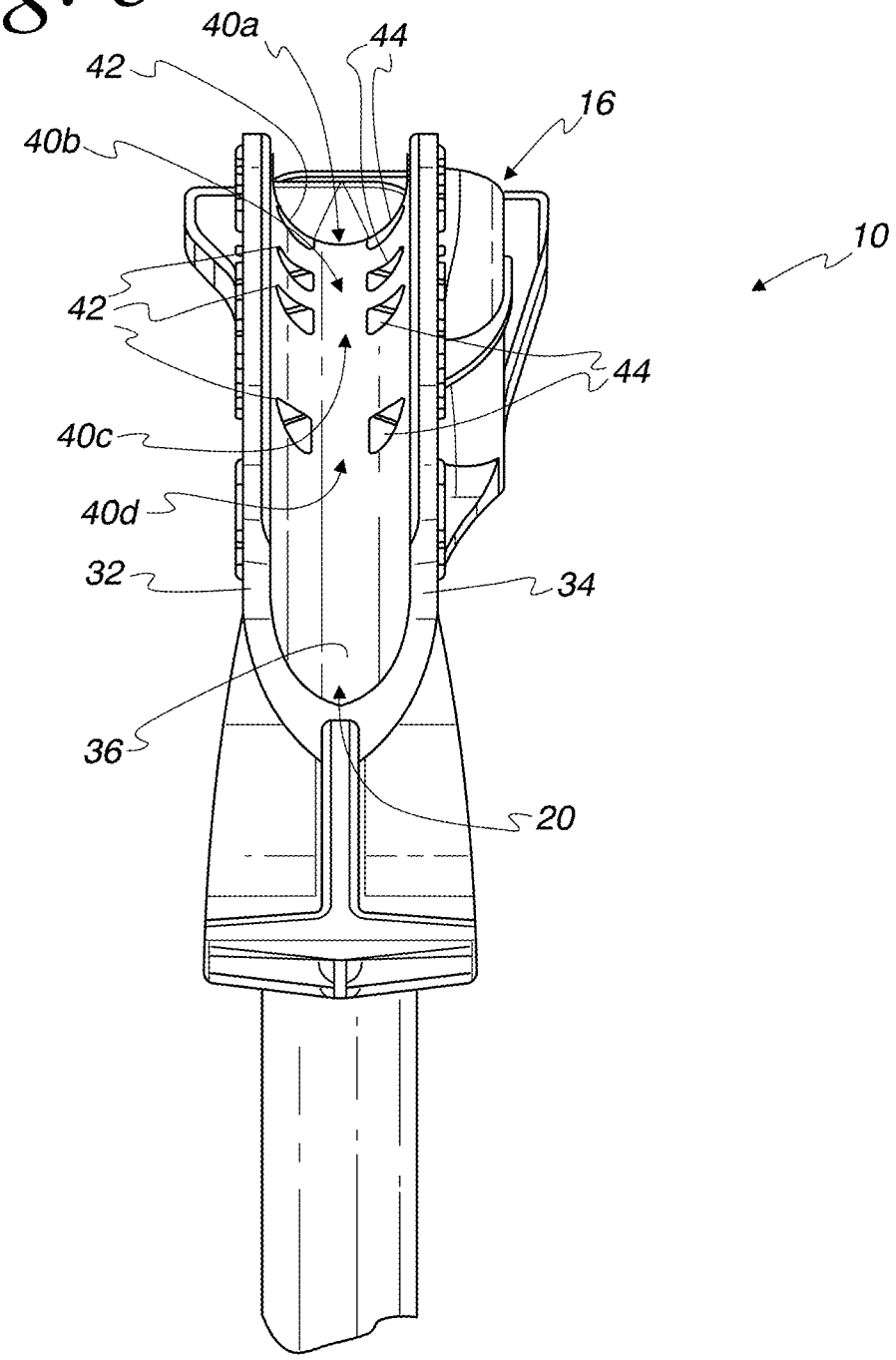
FIG. 8 is a view taken from line 8-8 in FIG. 7, and showing the angle setter positioned above the conduit bender.
Figure 9:
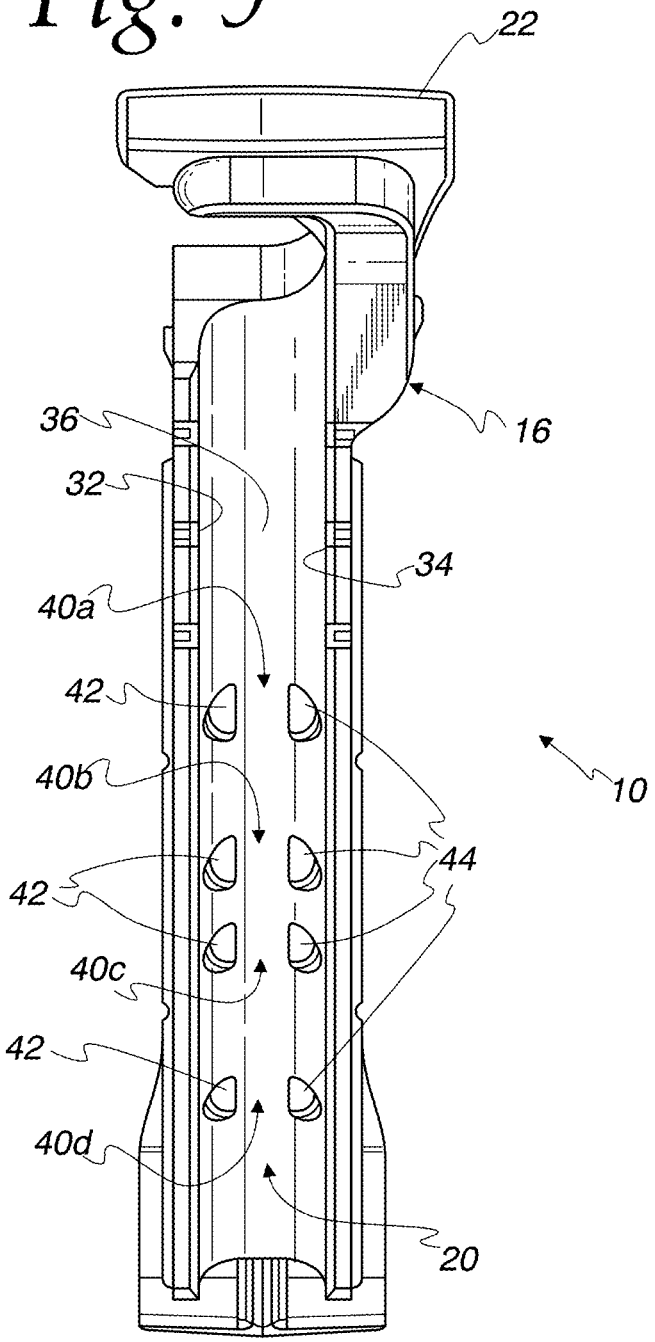
FIG. 9 is a view taken from line 9-9 in FIG. 7.
Figure 10:
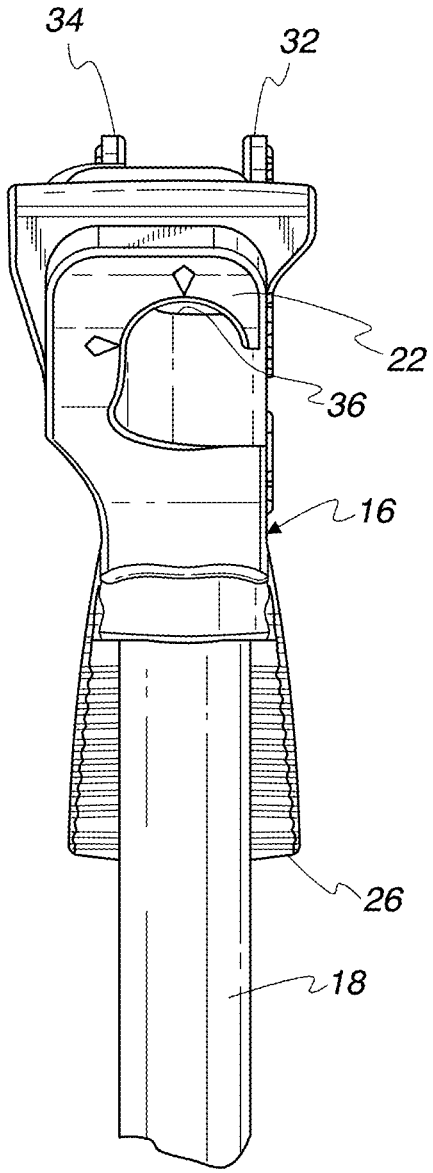
FIG. 10 is a view taken from line 10-10 in FIG. 7.
Figure 11:
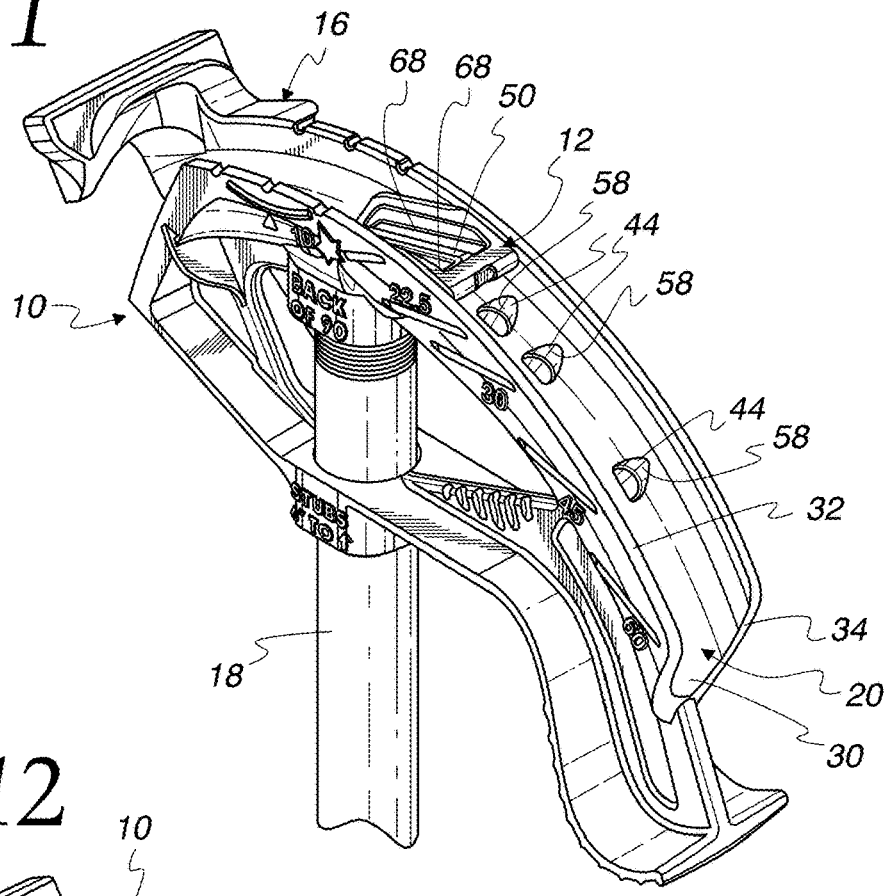
FIGS. 11-13 are views similar to FIG. 5, but showing another embodiment of the angle setter engaged at alternate positions in the conduit bender.
Figure 12:
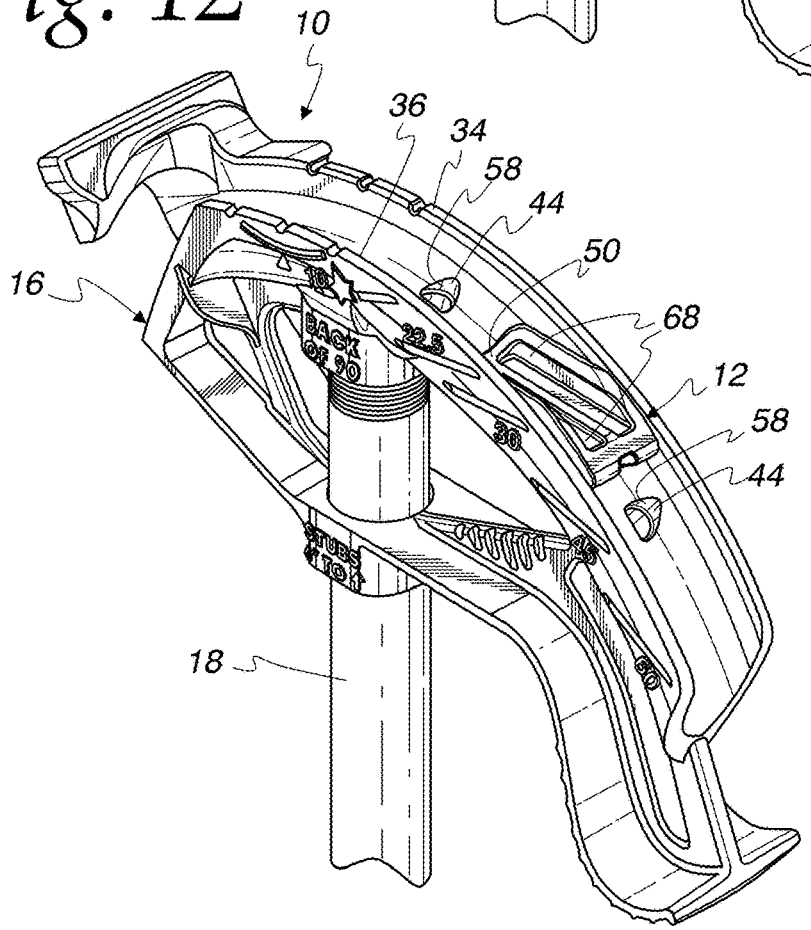
Figure 13:
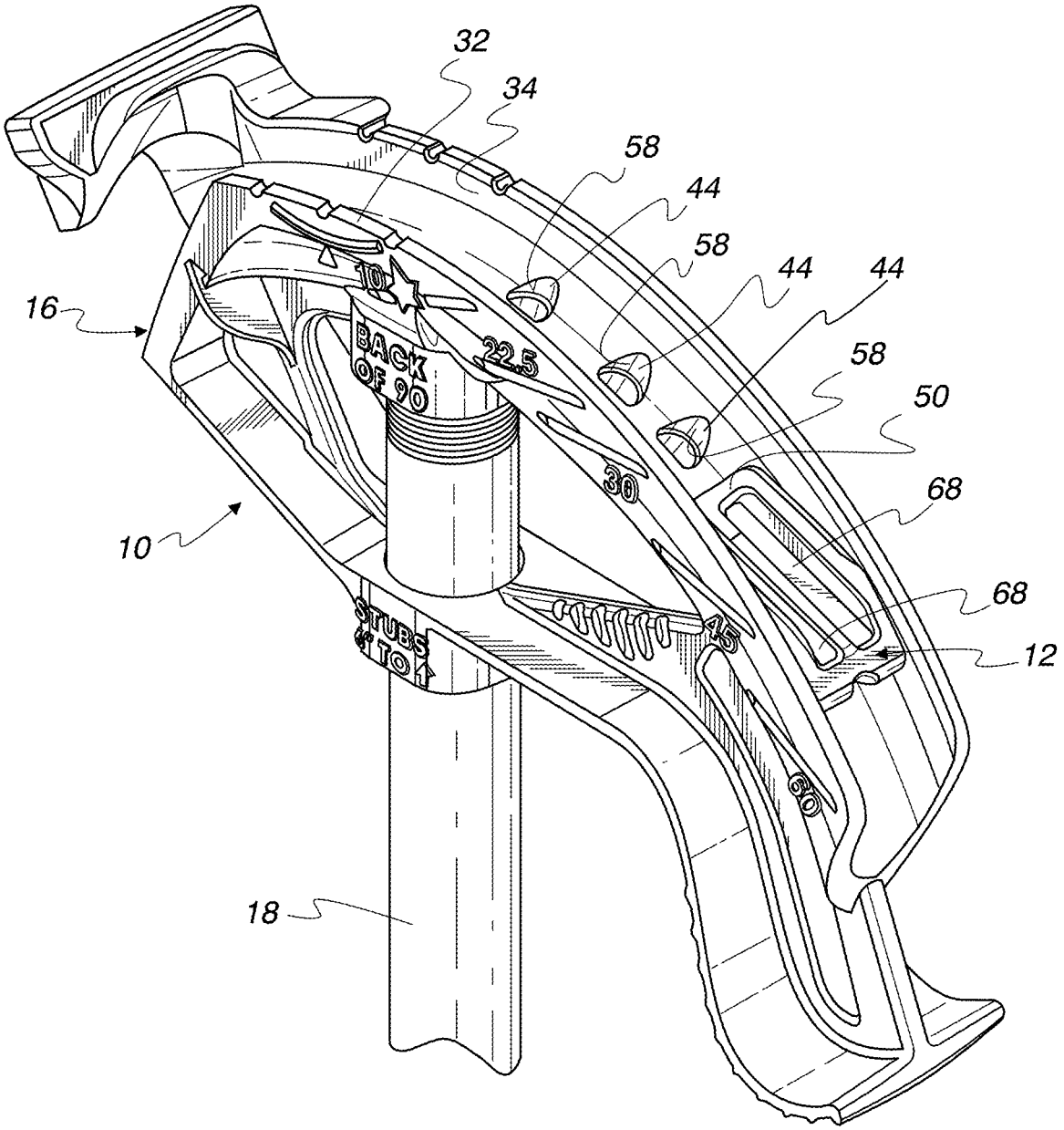

As best seen in FIGS. 8-9, in the illustrated embodiments, the bender head 10 includes pairs 40 of grooves 42 and 44 spaced along the channel 20, with the groove 42 of each pair 40 being formed in the sidewall 32 and the groove 44 of each pair 40 being formed in the other sidewall 34. As will be explained in greater detail below, the angle setter 12 is selectively engagable in the channel 20 at a plurality of positions defined by the spaced pairs 40 of grooves 42 and 44, with each position corresponding to a desired conduit bend angle. In this regard and as best seen in FIG. 7, in the illustrated embodiments, the pair 40*a* defines a position for the angle setter 12 that will produce a 10 degree bend in a conduit 14, the pair 40*b* defines the position for a 22.5 degree bend in a conduit 14, the pair 40*c* defines the position for a 30 degree bend in a conduit 14, and the pair 40*d* defines the position for a 45 degree bend in a conduit. While preferred and common bend angles have been shown in the illustrated embodiments, it should be understood that a pair 40 of the grooves 42 and 44 could be provided in the channel 20 at a position for the angle setter 12 that will produce any desired bend angle in a conduit 14.

Figure 14:
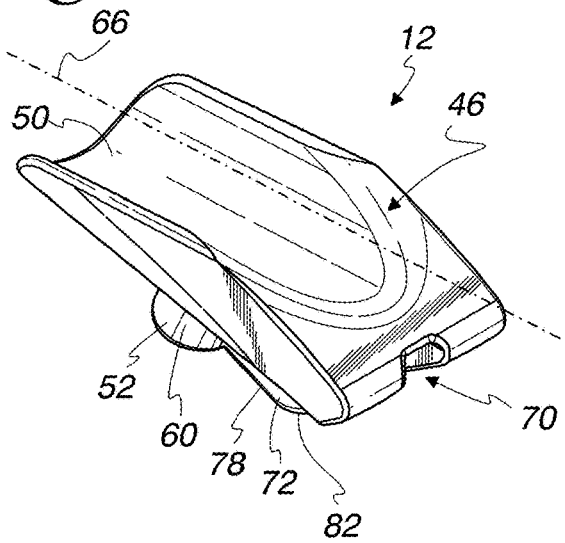
FIG. 14 is a perspective view from above and to the left of the embodiment of the angle setter shown in FIGS. 1-7.
Figure 15:
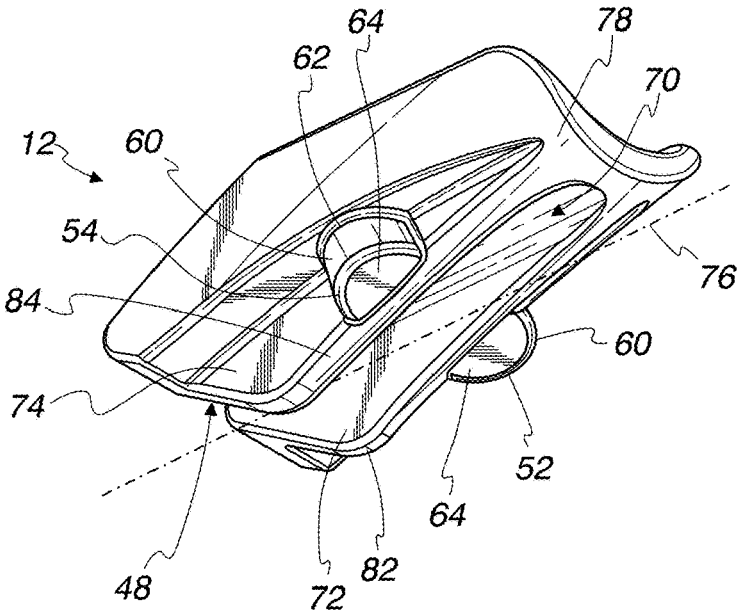
FIG. 15 is a perspective view from below and to the right of the embodiment of the angle setter of FIG. 14.
Figure 16:
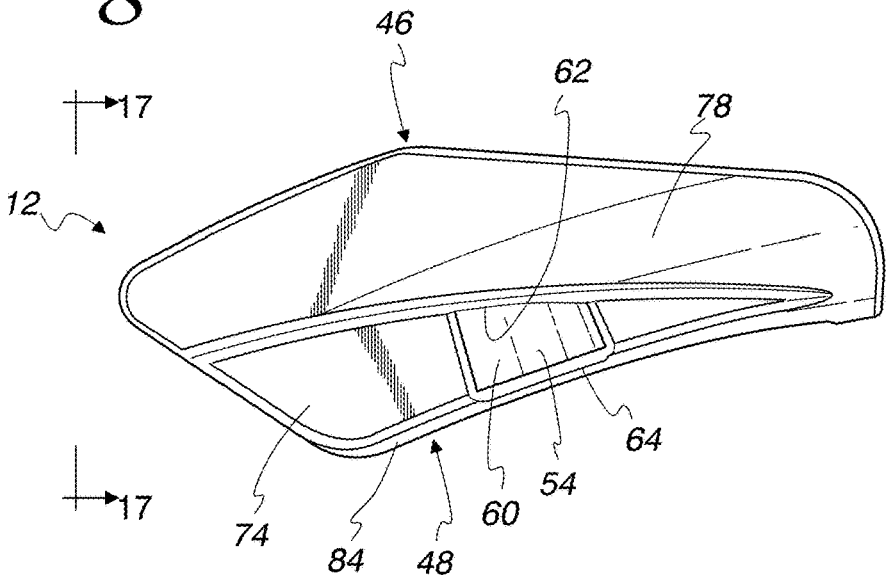
FIG. 16 is a right side elevation view of the embodiment of the angle setter of FIGS. 14 and 15.
Figure 17:
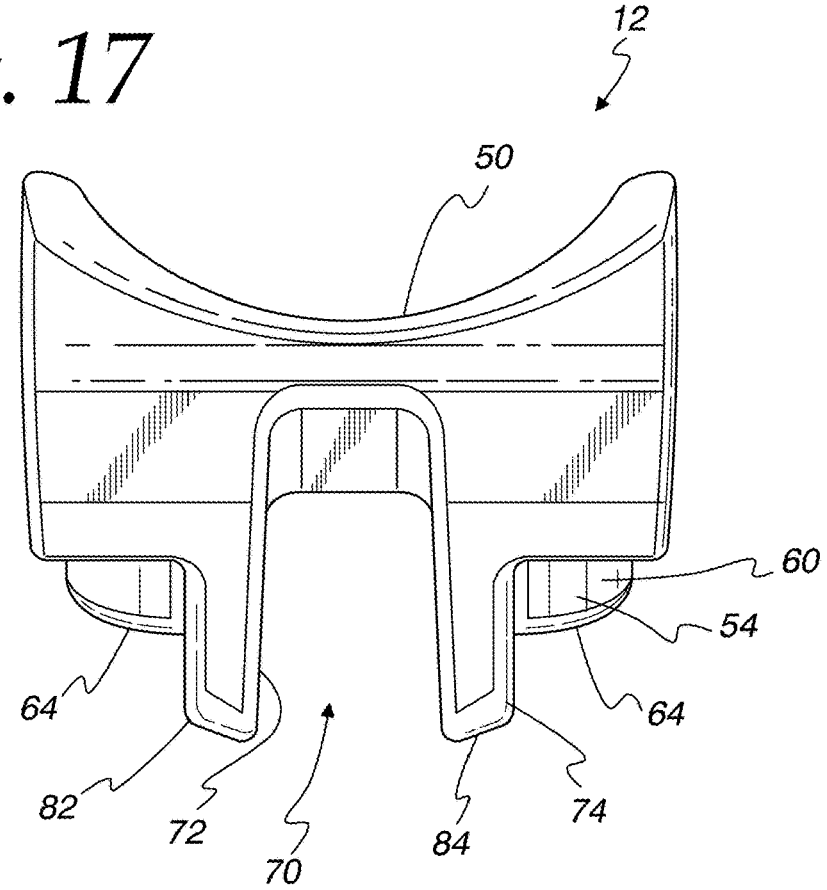
FIG. 17 is a view taken from line 17-17 in FIG. 15.
Figure 18:
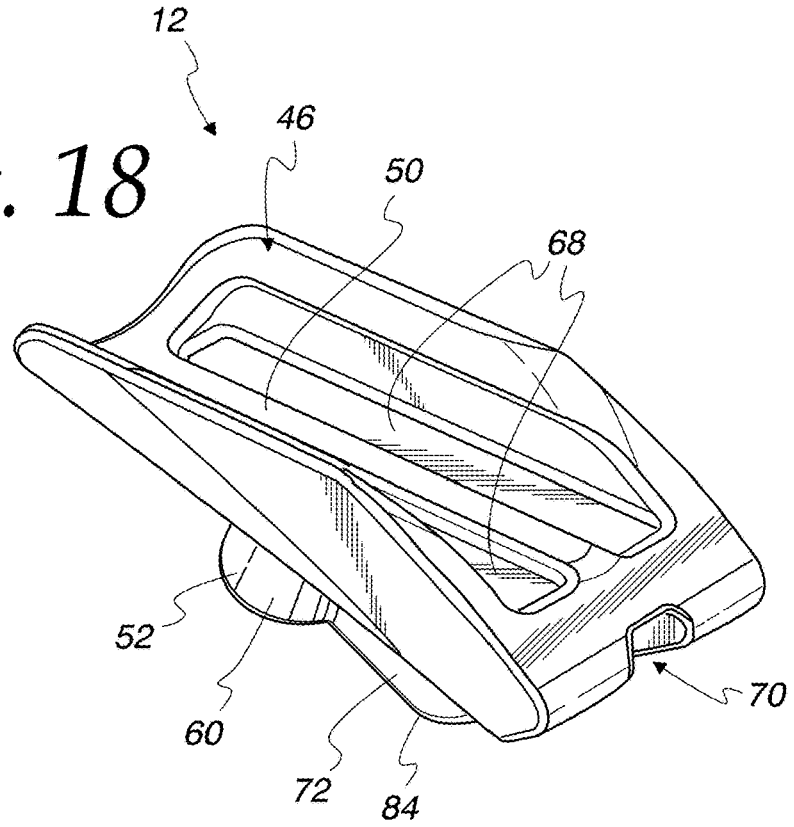
FIG. 18 is a view perspective view from above and to the left of the embodiment of the angle setter of FIGS. 11-13.
Figure 19:
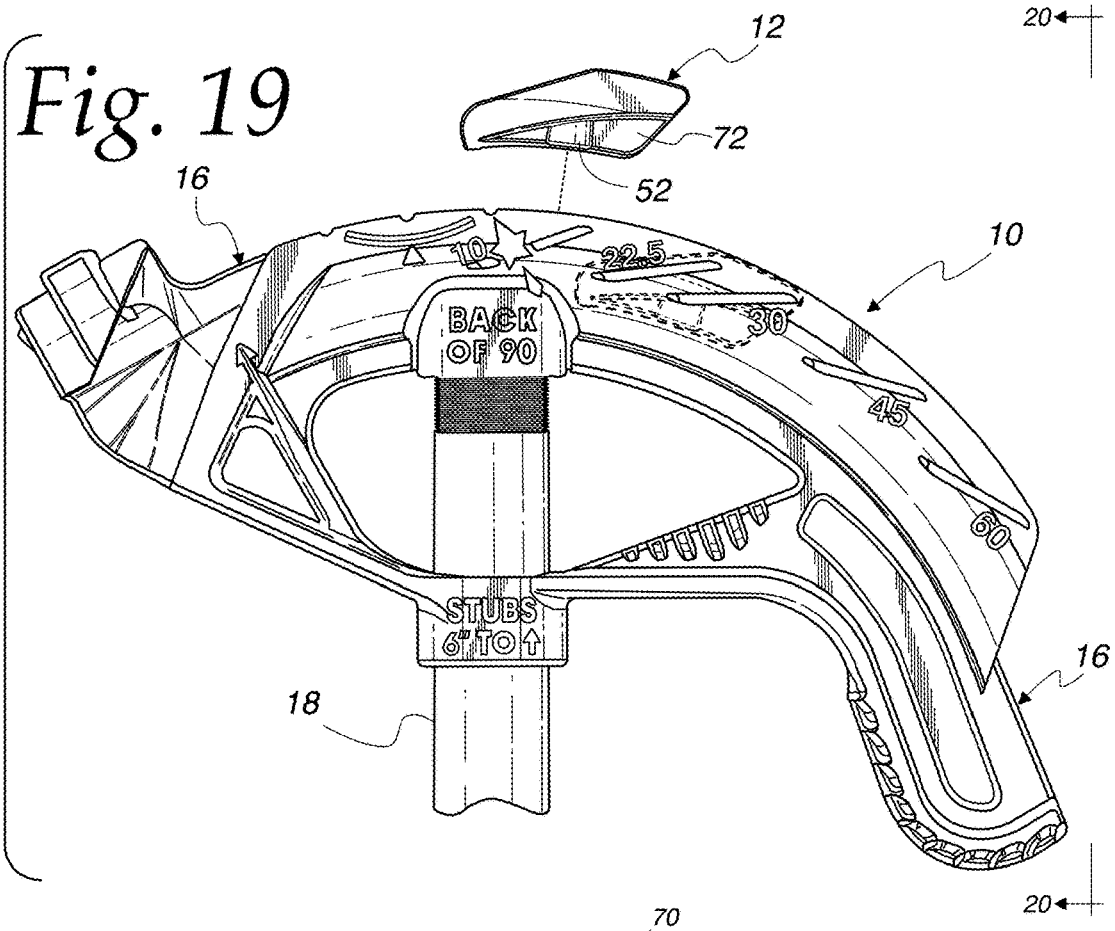
FIG. 19 is an exploded side elevation view of the conduit bender and the embodiment of the angle setter of FIGS. 11-13 and 18.
Figure 20:
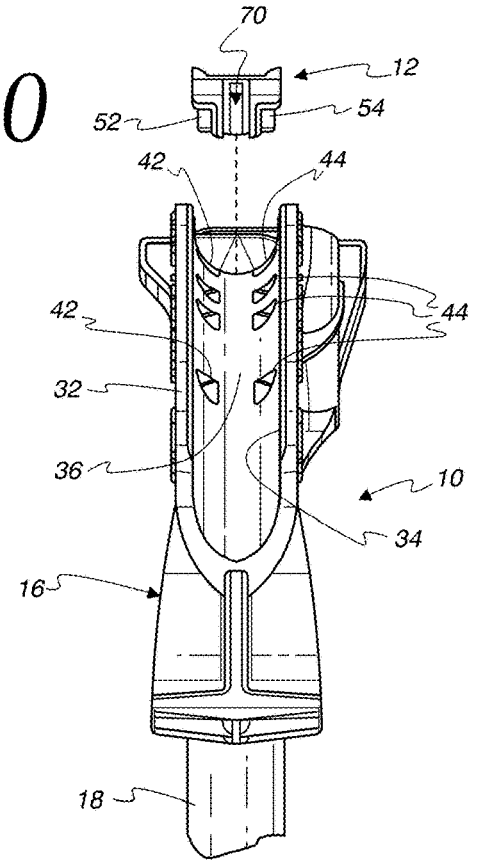
FIG. 20 is a view taken from line 20-20 in FIG. 19.
Figure 21:
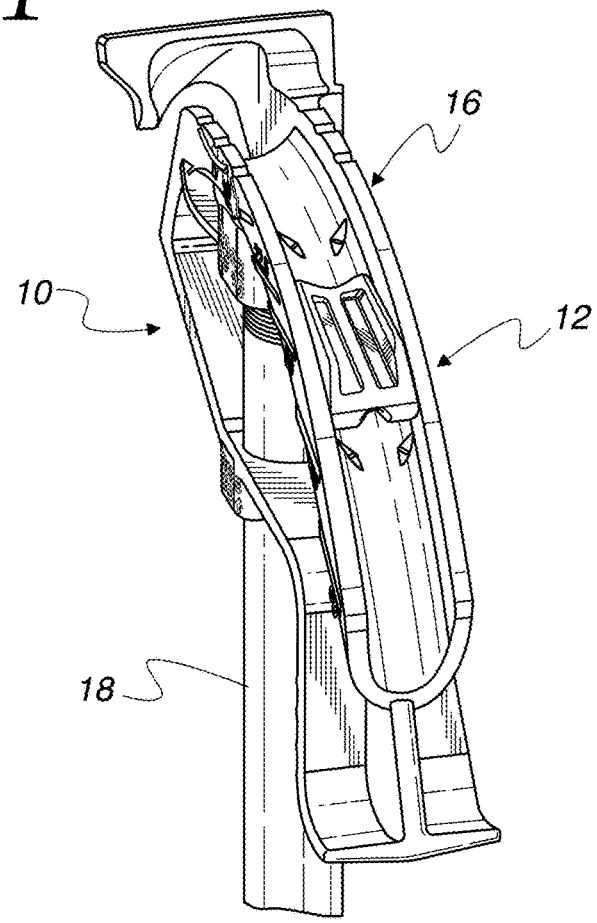
FIG. 21 is a perspective view from above and to the left of the conduit bender and the embodiment of the angle setter of FIGS. 11-13 and 18-20.
Figure 22:
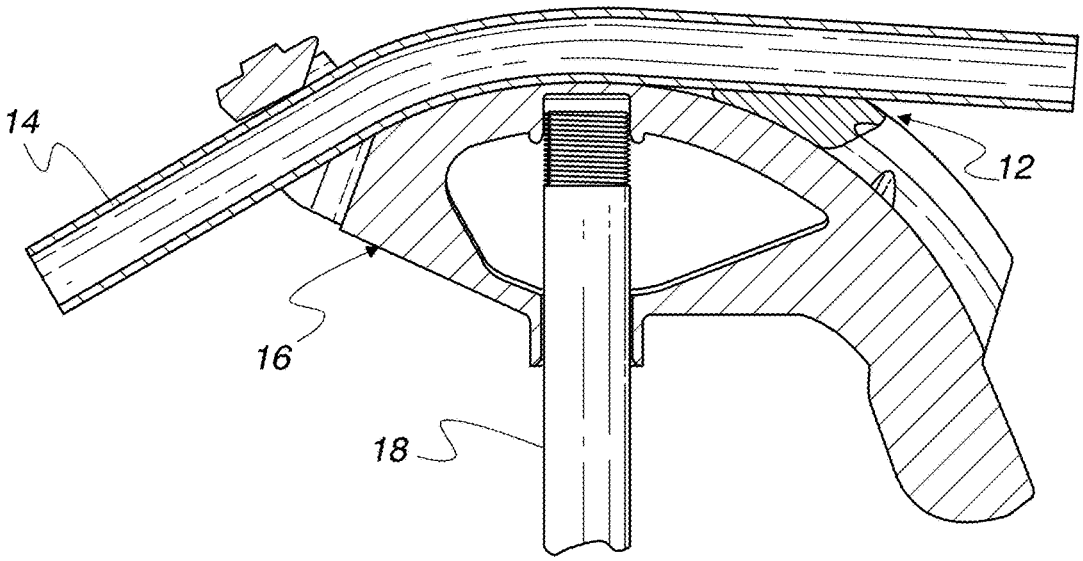
FIG. 22 is a longitudinal cross-section view of the conduit bender and angle setter of FIG. 21 and showing a conduit during bending.

The angle setter 12 in the illustrated embodiment is a unitary, one-piece component (i.e., made from a single piece of material) and has a face 46 that is directed away from the channel 20 when the angle setter 12 is engaged in the channel 20, and an opposite face 48 that is directed into the channel 20 when the angle setter 12 is engaged in the channel 20. The angle setter 12 includes a stop surface 50 on the face 46 to engage a length of the conduit 14 as the conduit 14 is being bent, and a pair of ribs 52 and 54 on the face 48 that locate the stop surface 50 relative to each pair 40 of the grooves 42 and 44. In this regard, the ribs 52 and 54 are cantilevered and face in opposite directions (laterally outwardly). The spacing between the ribs 52 and 54 is slightly larger than the spacing between the grooves 42 and 44 of each pair 40 so that the rib 52 is biased into engagement with each of the grooves 42 and the rib 54 is biased into engagement with each of the grooves 44 as the angle setter 12 is engaged with each pair 40*a*-40*d* of the grooves 42 and 44. It is preferred that the ribs 52 and 54 and the grooves 42 and 44 have conforming shapes. In this regard, in the illustrated embodiment, each groove 42 and 44 is defined by a concave, semicylindrical surface 58, and each rib is defined by a convex, semicylindrical surface 60 that conforms to shape of the surfaces 58. As best seen in FIG. 15, the surface 60 of each rib 52 and 54 extends from a base 62 to a terminal end 64. As best seen in FIG. 14, in the illustrated embodiment, the stop surface 50 extends along a longitudinal axis 66 and has a convex, arcuate profile transverse to the longitudinal axis. In some embodiments, the stop surface 50 may have a semicylindrical shape that is centered on the axis 66. As shown by the embodiment of the angle setter 12 shown in FIGS. 1-7 and 14-17, the stop surface 50 can be a continuous surface. As shown by the embodiment of the angle setter 12 shown in FIGS. 11-13 and 18-24, the stop surface 50 can be discontinuous, with channels 68 interrupting the surface 50. It should be noted that, with the exception of the configuration of the surface 50 and the channels 68 on the face 46, both embodiments of the angle setter 12 shown in FIGS. 1-24 are identical.

Figure 6:
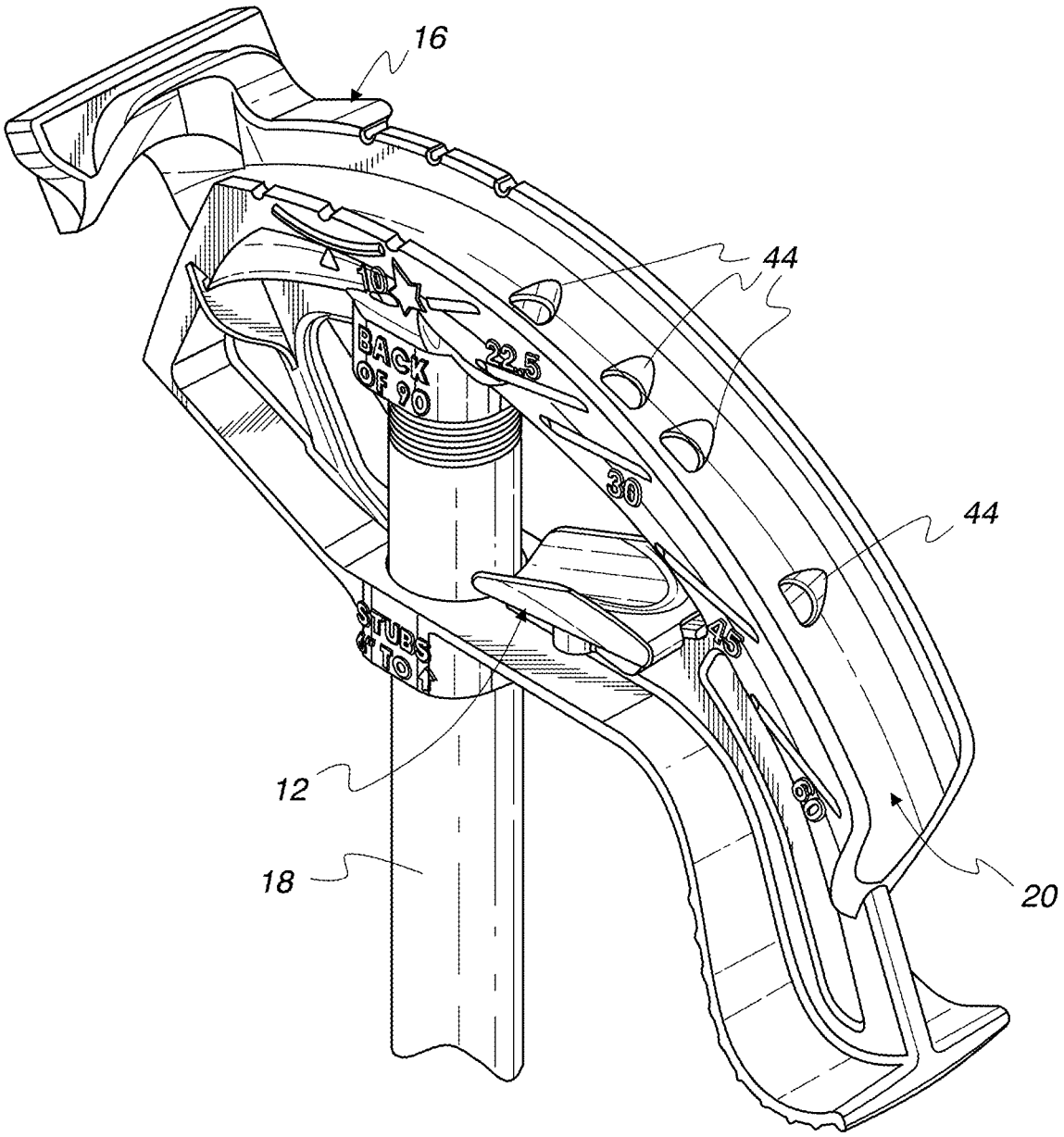
FIG. 6 is a view identical to FIG. 5, but with the angle setter shown in stored position on the conduit bender.
Figure 23:
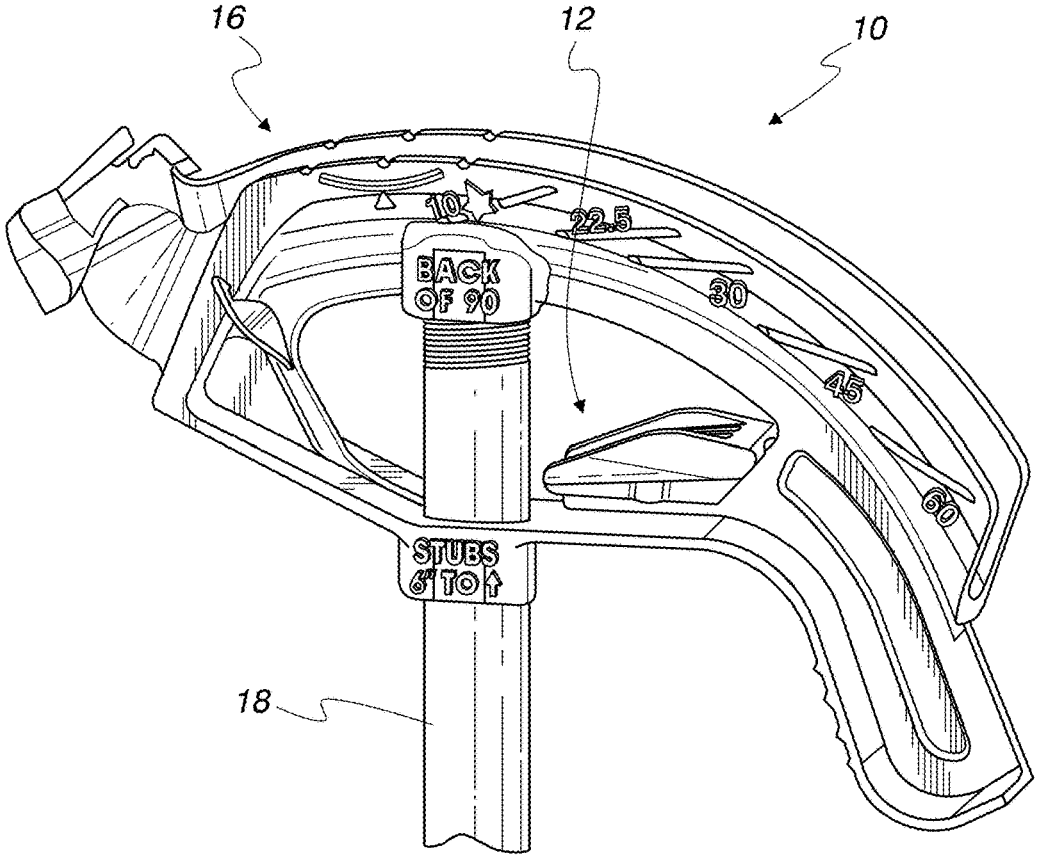
FIG. 23 is a perspective view from the left side of the conduit bender and angle setter of FIG. 21.
Figure 24:
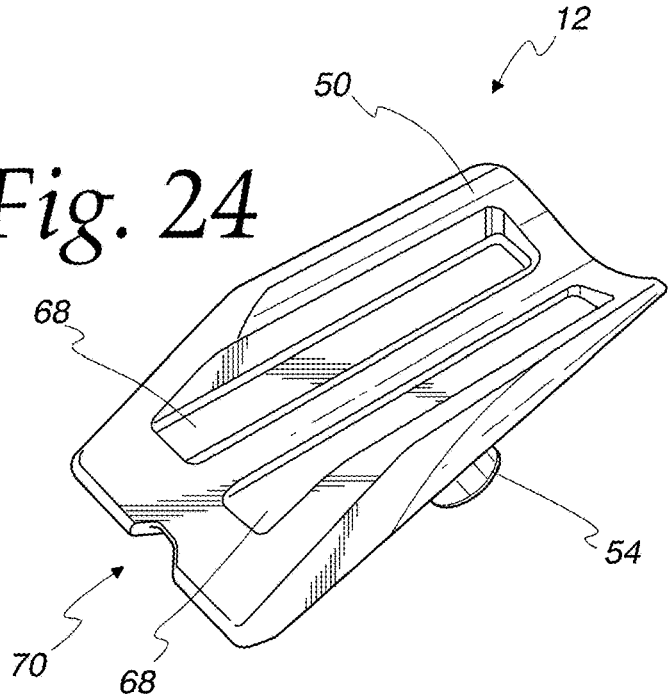
FIG. 24 is a perspective view from above and to the right of the angle setter of FIGS. 11-13, 18-23.

In the illustrated and preferred embodiments, the angle setter 12 also includes an elongate channel 70 on the face 48 that is configured to releasably receive a portion of the webs 30, as best seen in FIGS. 6, 7 and 23. In this regard, the channel 70 preferably has a width that is slightly less than the thickness of at least one of the webs 30 so that the sides of the channel 70 are biased against the web 30 when the web 30 is inserted in the channel 70. The channel 70 allows for the angle setter 12 to be carried in a stored position on the bender 10, as shown in FIGS. 6, 7 and 23. The channel 70 of the illustrated embodiments is defined between two cantilevered walls 72 and 74, with the rib 52 formed on the wall 72 and the rib 54 formed on the wall 74, and both ribs 52 and 54 facing away from the channel 70. It should be appreciated that because they are cantilevered, the ribs 52 and 54 and walls 72 and 74 function as leaf springs. In the illustrated embodiment, the channel 70 extends along an axis 76 that is coplanar with the axis 66.

Preferably and as shown in the illustrated embodiments, the angle setter includes a bottom surface 78 that is shaped to conform to the arcuate channel 20, with each wall 72 and 74 terminating at surfaces 82 and 84 that define portions of the bottom surface 78.

Figure 25:
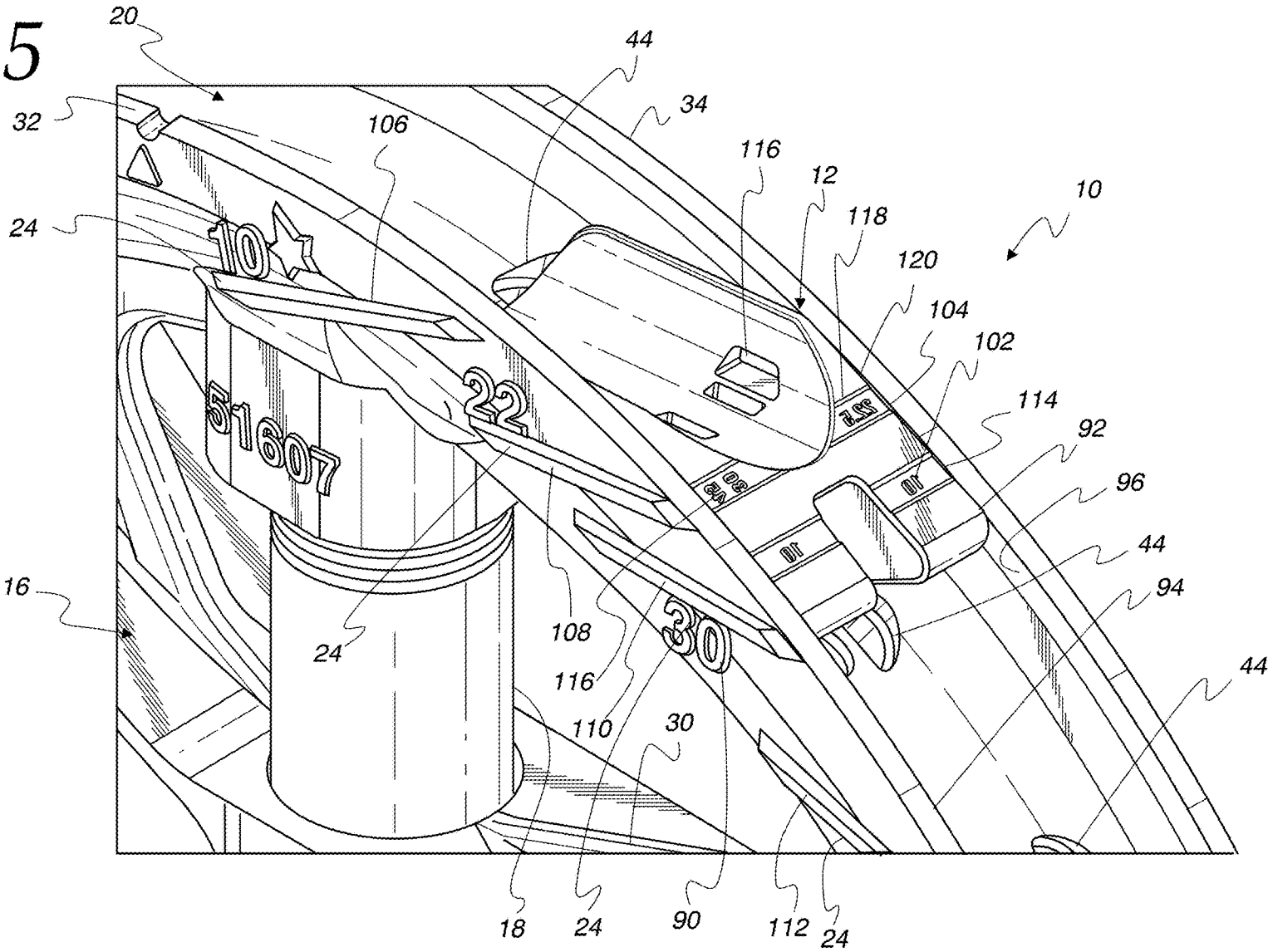
FIG. 25 is a perspective view from above and to the left of the conduit bender and another embodiment of the angle setter.
Figure 26:
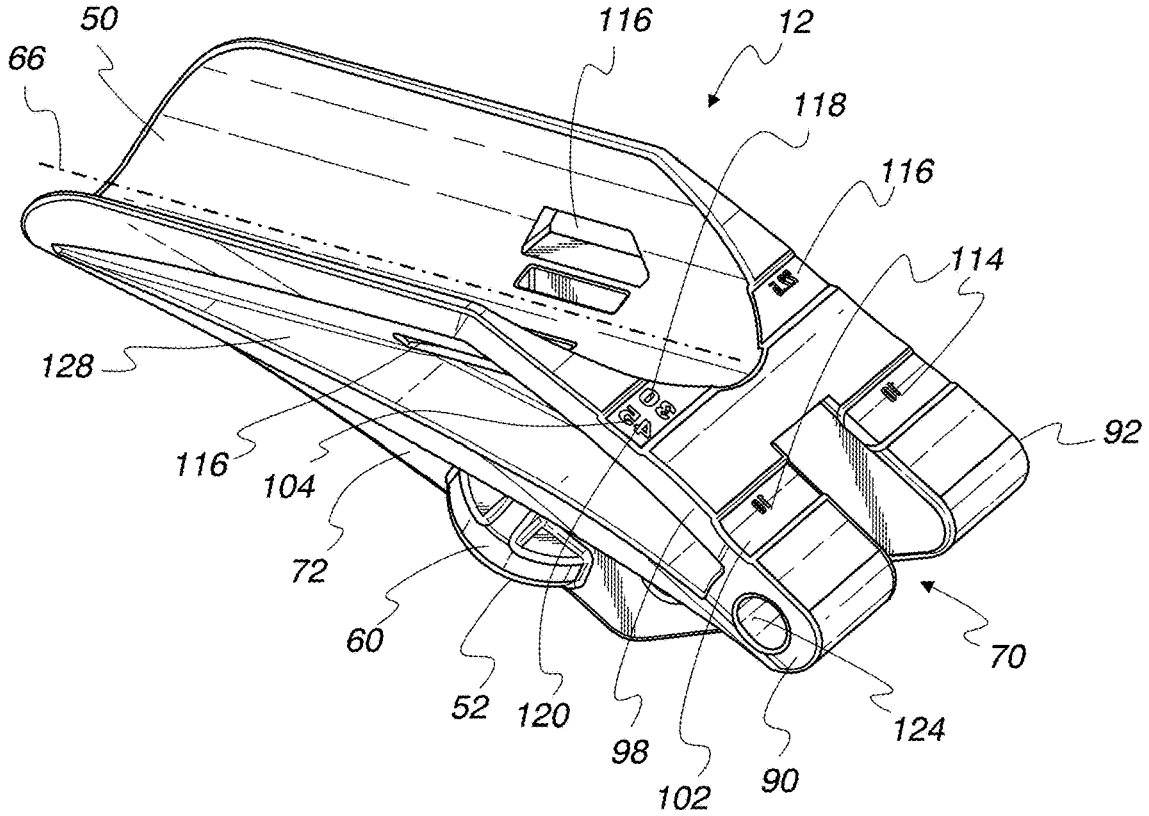
FIG. 26 is a perspective view from above and to the left of the embodiment of the angle setter shown in FIG. 25.
Figure 27:
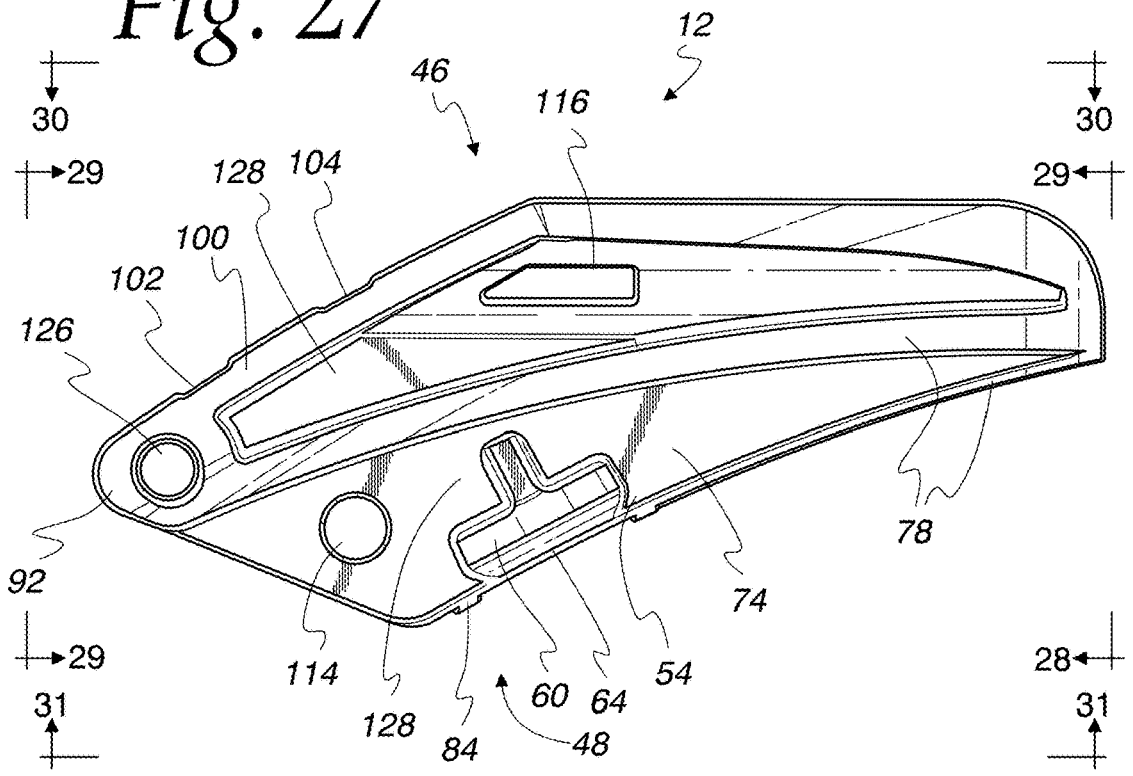
FIG. 27 is a right side elevation view of the embodiment of the angle setter of FIGS. 25 and 26.
Figure 28:
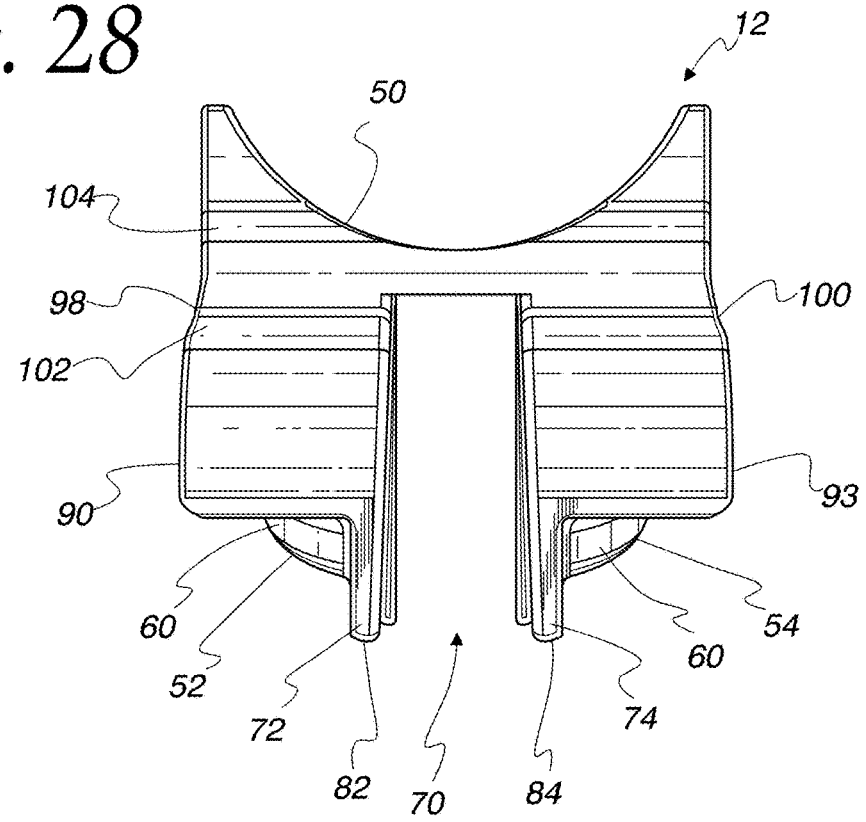
FIG. 28 is a view taken from line 28-28 in FIG. 27.
Figure 29:
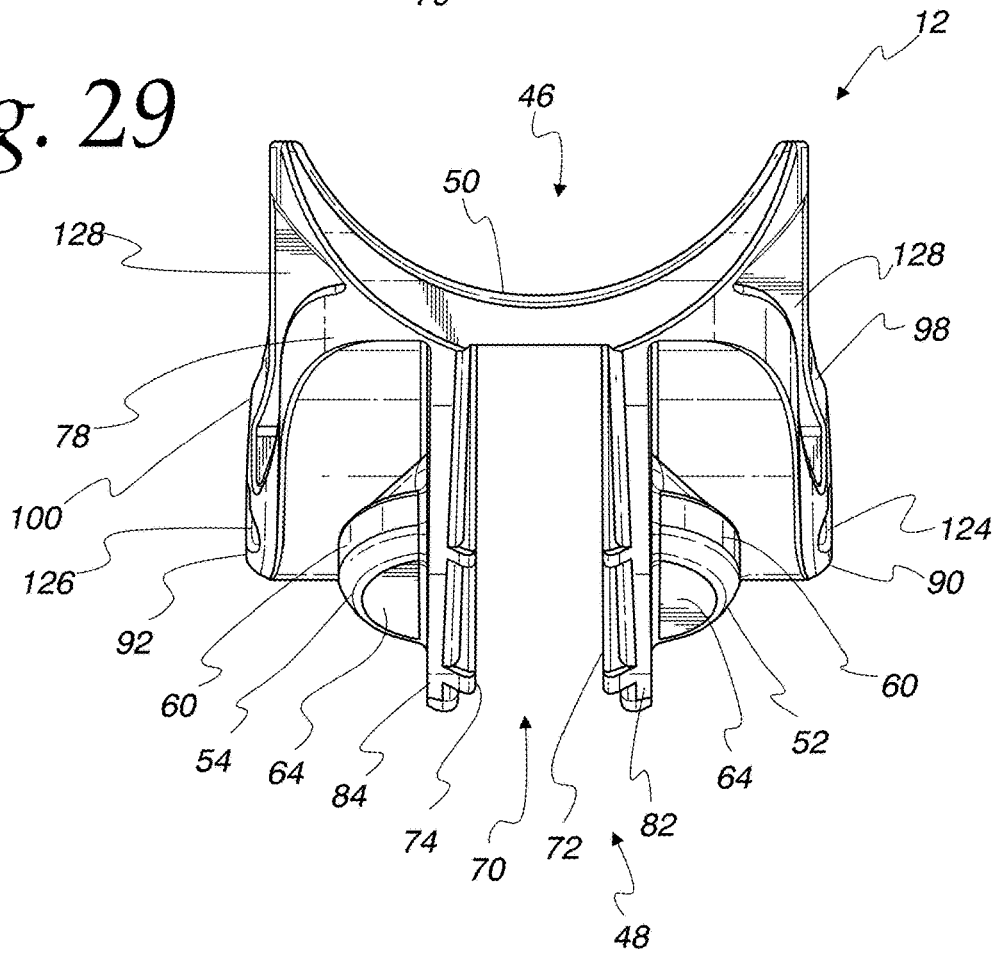
FIG. 29 is a view taken from line 29-29 in FIG. 27.
Figure 30:
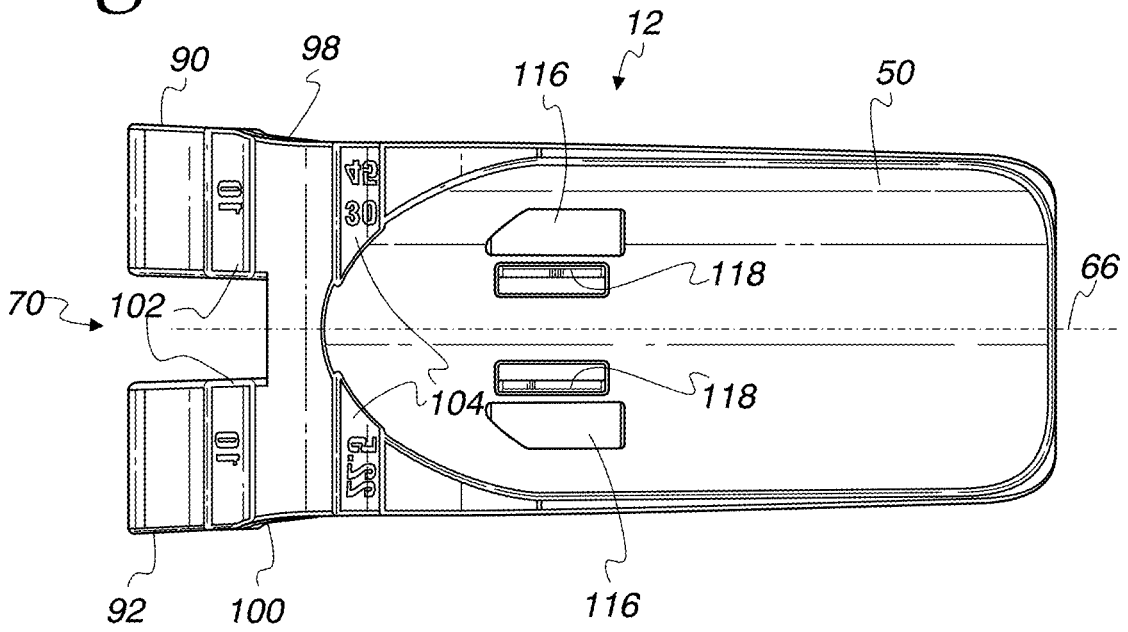
FIG. 30 is a view taken from line 30-30 in FIG. 27.
Figure 31:
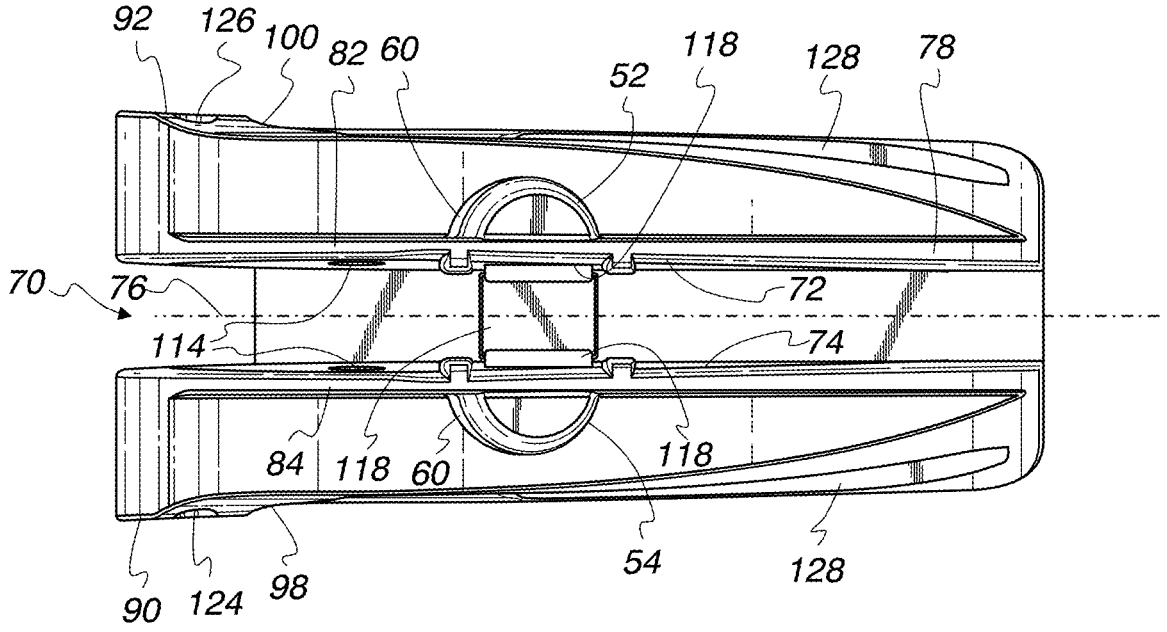
FIG. 31 is a view taken from line 31-31 in FIG. 27.
Figure 32:
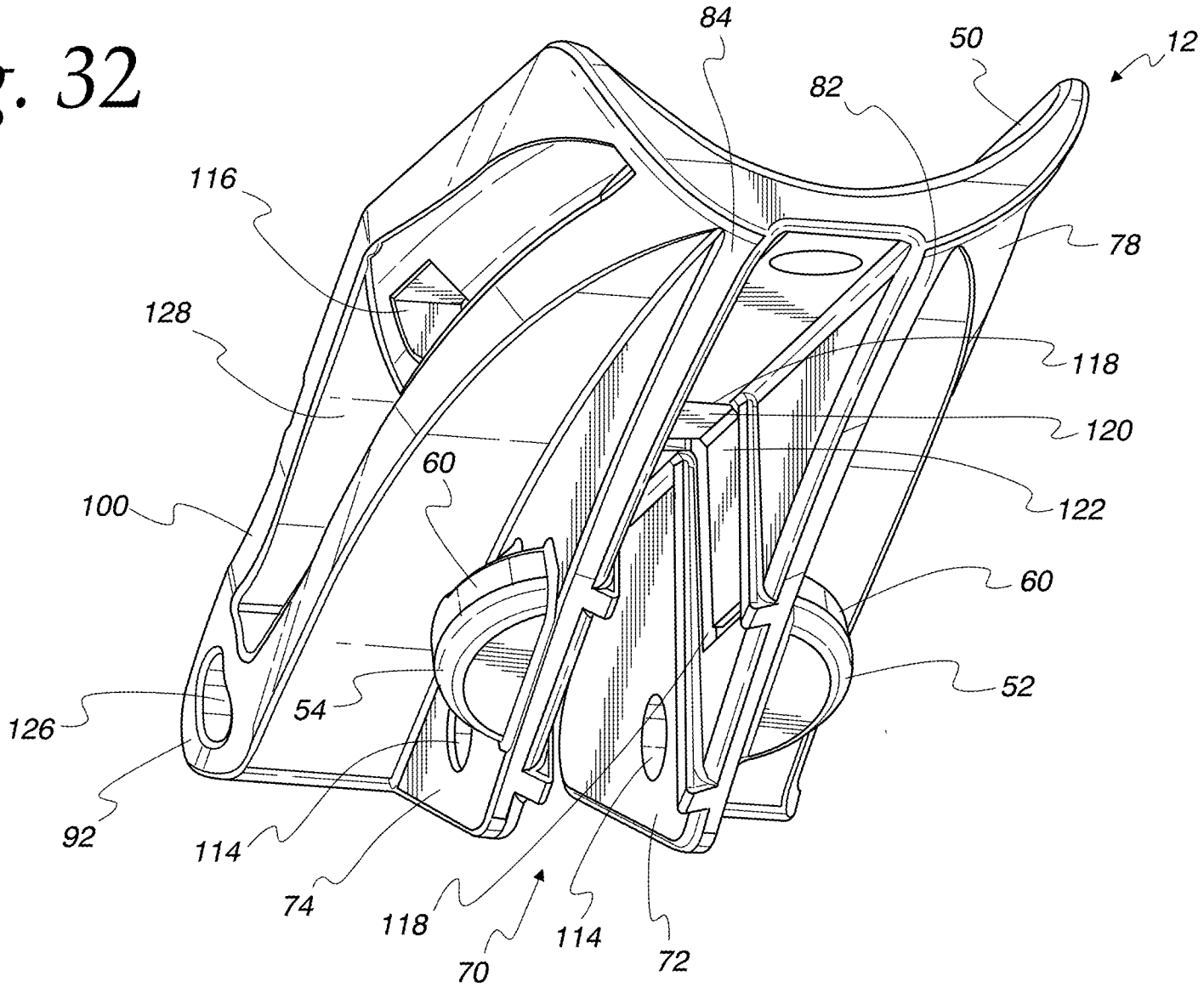
FIG. 32 is a perspective view from below and to the right-front of the angle setter of FIGS. 25-31 and showing an optional leaf spring installed in the angle setter.
Figure 33:
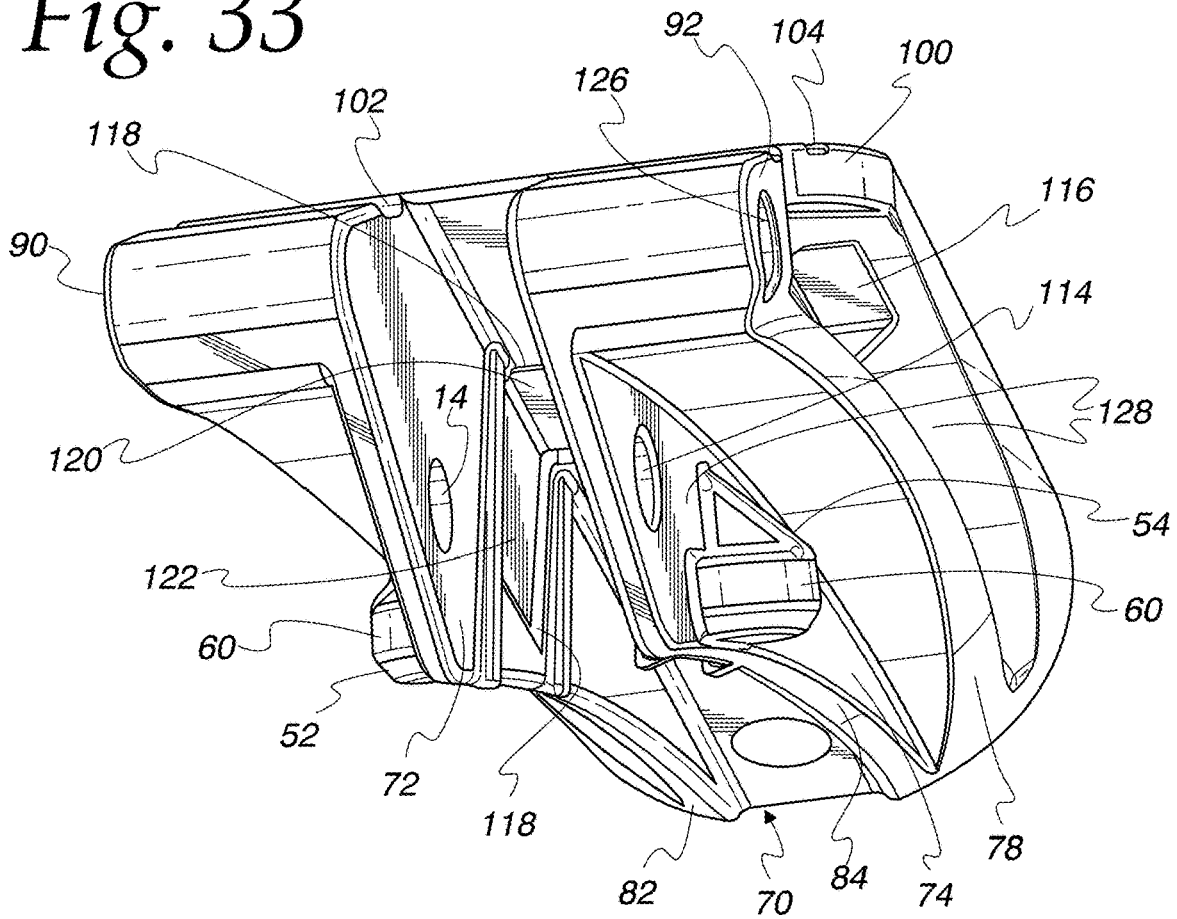
FIG. 33 is a view similar to FIG. 32 but taken from below and to the right-rear.
Figure 34:
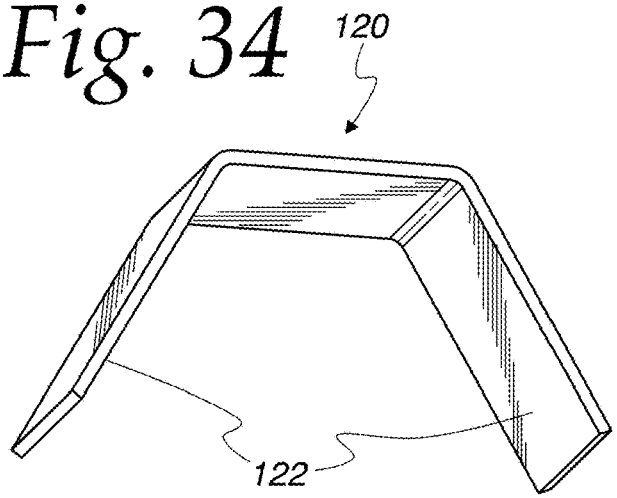
FIG. 34 is a perspective view of the leaf spring shown in FIGS. 32 and 33, with the spring in an uncompressed condition.
Figure 35:
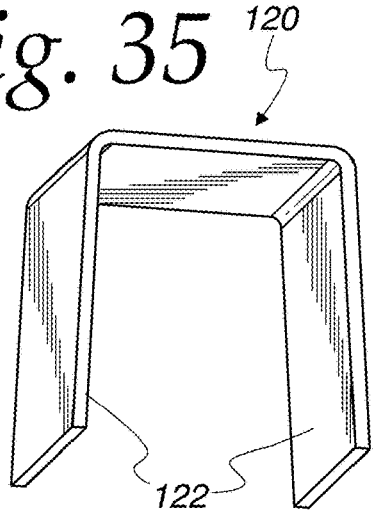
FIG. 35 is a view similar to FIG. 34 but showing the leaf spring in a compressed condition.

Another embodiment of the angle setter 12 is shown in FIGS. 25-31 wherein certain features have been added in comparison to the embodiments of the angle setter 12 shown in FIGS. 1-24. In this regard, oppositely facing side surfaces 90 and 92 have been sized/congigured to insure an interference fit with inwardly facing surfaces 94 and 96 of the channel 20 to retain the angle setter 12 in the channel 20 with the angle setter setter 12 is engaged with each pair 40*a*-40*d* of the grooves 42 and 44. More specifically, the spacing between the surfaces 90 and 92 is larger than the spacing between the surfaces 94 and 96 so that the surfaces 90 and 92 are biased into engagement with the surfaces 90 and 92 as the angle setter 12 is engaged with each pair of 40*a*-40*d* of the grooves 42 and 44. As best seen in FIGS. 30 and 31, it is preferred that adjacent surfaces 98 and 100 on the angle setter 12 be sized/configured so that they do not have an interference fit with surfaces in the channel 20. As another additional feature and as best seen in FIG. 25, the angle setter 12 includes a visual alignment aid in the form of laterally extending, linear reliefs 102 and 104 that allow a user to visually align the releifs with a corresponding one of the angle indicator ribs 106, 108, 110, and 112 so as to easily locate the grooves 42 and 44 with respect to the ribs 52 and 54 when engaging the angle setter 12 into the channel 20. Additionally as best seen in FIG. 25, indicia 114 ("10"), 116 ("22.5"), 118 ("30"), and 120 ("45") can be included to provide a visual indicator to a user as to which of the reliefs 102 or 104 should be aligned with the desired indicator rib 106, 108, 110, or 112 to provide proper location of the ribs 52 and 54 with the grooves 42 and 44 (indicia not shown in FIGS. 28 and 30). In yet another additional feature and as best seen in FIGS. 32 and 33, through openings 114 have been added to each of the walls 72 and 74 to allow a tether (not shown) to optionally be attached to the angle setter 12 and the conduit bender head 16. As a further feature, through openings 116 have been added to allow the angle setter 12 to be "zip tied" to the conduit bend head 16 when the angle setter 12 is in the stored position shown in FIGS. 6, 7, and 23, which may be desirable during long periods of storage or during shipment. As yet another additional feature and as best seen in FIGS. 31-35, reliefs 118 have been added to receive an optional, u-shaped leaf spring 120 (shown in FIGS. 32-35) that can increase the bias force urging the ribs 52 and 54 into engagement with the grooves 42 and 44. In this regard, FIG. 34 shows the spring 120 with legs 122 in an uncompressed condition and FIGS. 32, 33, and 35 show the spring 120 with the legs 122 in a compressed condition that will biase the walls 72 and 74, and in turn the ribs 52 and 54, outwardly. As another additional feature, bores 124 and 126 are provided in the surfaces 90 and 92, respectively, to receive an optional cyclindrical shaped friction enhancing inserts (not shown) that can be included to increase the friction/grip between the angle setter 12 and the surfaces 94 and 96 of the channel 20. In a further feature, manufacturing reliefs 128 are provided at selected locations in the angle setter 12 to improve the manufacturing outcome of the angle setter when it is formed by injections molding.

While any suitable material can be used for the angle setter 12 and the bender head 16, it some embodiments it will be preferable to form the angle setter 12 from a suitable polymeric material, such as a suitable elastomer, that provides a beneficial resiliency and for the bender head 16 to be made from a suitable metal.

Preferred embodiments of the inventive concepts are described herein, including the best mode known to the inventor(s) for carrying out the inventive concepts. Variations of those preferred embodiments will become apparent to those of ordinary skill in the art upon reading the foregoing description. The inventor(s) expect skilled artisans to employ such variations as appropriate, and the inventor(s) intend that the inventive concepts can be practiced otherwise than as specifically described herein. Accordingly, the inventive concepts disclosed herein include all modifications and equivalents of the subject matter recited in the claims appended hereto as permitted by applicable law. Moreover, any combination of the above-described elements and features in all possible variations thereof is encompassed by the inventive concepts unless otherwise indicated herein or otherwise clearly contradicted by context. Further in this regard, while highly preferred forms of the bender 10 and angle setter 12 are shown in the figures, it should be understood that this disclosure anticipates variations in the specific details of each of the disclosed components and features of the bender 10 and angle setter 12 and that no limitation to a specific form, configuration, or detail is intended unless expressly and specifically recited in an appended claim.

For example, while specific and preferred forms have been shown for the grooves 42 and 44 and the ribs 52 and 54, other forms and orientations are possible. For example, the shapes other than semi-cylindrical and/or other positions in the channel 20 and on the angle setter 12 may be desirable. As another example, while it is preferred that the angle setter be a unitary, one-piece construction, in some applications it may be desirable for one or more features of the angle setter 12 to be provided as separate components that are assembled together to form the angle setter 12.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. The use of any and all examples, or exemplary language (e.g., "such as") provided herein, is intended merely to better illuminate the inventive concepts disclosed herein and does not pose a limitation on the scope of any invention unless expressly claimed. No language in the specification should be construed as indicating any non-claimed element as essential to the practice of the inventive concepts disclosed herein.

All references, including publications, patent applications, and patents, cited herein are hereby incorporated by reference to the same extent as if each reference were individually and specifically indicated to be incorporated by reference and were set forth in its entirety herein.

Examples of inventive subject matter that could be claimed for this disclosure are provided below:

1. A manual conduit bender comprising:
   a bender head comprising
   an arcuate channel configured to receive a length of conduit as it is being bent, the channel defined by opposed side wall joined by a base; and
   at least two pairs of grooves spaced along the channel, with one groove of each pair being formed in one of the sidewalls and the other groove of each pair being formed in the other of the sidewalls;
   an angle setter selectively engagable in the channel at a plurality positions defined by the spaced pairs of grooves, each position corresponding to a desired conduit bend angle, the angle setter comprising:
   a stop surface to engage a length of conduit as it is being bent; and
   a pair of ribs facing in opposite directions to releasably engage each pair of grooves to selectively locate the stop surface relative to each pair of grooves, each rib biased into engagement with the corresponding one of the grooves with the ribs engaged in one of the pair of grooves.
2. The manual conduit bender of claim 1 wherein each groove is defined by a concave, semicylindrical surface, and each rib is defined by a convex semicylindrical surface.
3. The manual conduit bender of claim 1 wherein the stop surface extends along a longitudinal axis and has a convex arcuate profile transverse to the longitudinal axis.
4. The manual conduit bender of claim 3 wherein the bender head further comprises at least one structural web underlying the arcuate channel, and the angle setter further comprises an elongate channel configured to releasably receive a portion of the web to retain the angle setter in a stored position on the manual conduit bender.
5. The manual conduit bender of claim 4 wherein the elongate channel extends along an axis that is coplanar with the longitudinal axis.
6. The manual conduit bender of claim 4 wherein the elongate channel and the stop surface are located on opposite faces of the angle setter.
7. The manual conduit bender of claim 1 wherein the bender head further comprises at least one structural web underlying the arcuate channel, and the angle setter further comprises an elongate channel configured to releasably receive a portion of the web to retain the angle setter in a stored position on the manual conduit bender.
8. The manual conduit bender of claim 7 wherein the elongate channel is defined between two spaced walls with one of the ribs formed on one of the walls and the other rib formed on the other wall.
9. The manual conduit bender of claim 8 wherein each rib is formed on a side of the corresponding wall that faces away from the elongate channel.
10. The manual conduit bender of claim 8 wherein the angle setter further comprises a bottom surface that is shaped to conform to the arcuate channel, and each wall terminates at a surface that defines a portion of the bottom surface.
11. The manual conduit bender of claim 1 wherein the angle setter further comprises a bottom surface that is shaped to conform to the arcuate channel, the stop surface and the bottom surface located on opposite faces of the angle setter.
12. The manual conduit bender of claim 11 wherein the angle setter is sized so that no part of the angle setter extends outward from the arcuate channel with the bottom surface engaged against the arcuate channel and the ribs engaged in a pair of the grooves.
13. The manual conduit bender of claim 1 wherein the angle setter comprises a one-piece, unitary body and the stop surface and the ribs are formed on the body.
14. The manual conduit bender of claim 1 wherein each of the ribs comprises a convex surface extending from a base to a terminal end.
15. The manual conduit bender of claim 1 further comprising an elongate handle extending from the head.
16. The manual conduit bender of claim 15 wherein the head is a one-piece, unitary component and the handle is a separate component that is assembled to the head.
17. A manual conduit bender comprising:
    a bender head comprising
    an arcuate channel configured to receive a length of conduit as it is being bent, the channel defined by opposed side wall joined by a base; and a first pair of grooves in the channel, one groove of the pair being formed in one of the sidewalls and the other groove of the pair being formed in the other of the sidewalls;

an angle setter selectively engagable in the channel at a position defined by the pair of grooves and corresponding to a desired conduit bend angle, the angle setter comprising:

a stop surface to engage a length of conduit as it is being bent; and a pair of ribs facing in opposite directions to releasably engage each pair of grooves to selectively locate the stop surface relative to each pair of grooves, each rib biased into engagement with the corresponding one of the grooves with the ribs engaged in one of the pair of grooves.

18. The manual conduit bender of claim 17 wherein the bender head comprises at least two pairs of grooves spaced along the channel, with one groove of each pair being formed in one of the sidewalls and the other groove of each pair being formed in the other of the sidewalls, the first pair of grooves being one of the at least two pairs; and wherein the angle setter is selectively engagable in the channel at a plurality positions defined by the spaced pairs of grooves, each position corresponding to a desired conduit bend angle.

What is claims is:

1. A manual conduit bender comprising:

a bender head comprising:

an arcuate channel configured to receive a length of conduit as it is being bent, the channel defined by opposed sidewalls joined by a base, and at least two pairs of grooves spaced along the channel, with one groove of each pair being formed in one of the sidewalls and the other groove of each pair being formed in the other of the sidewalls; and an angle setter selectively engagable in the channel at a plurality positions defined by the spaced pairs of grooves, each position corresponding to a desired conduit bend angle, the angle setter comprising:

a stop surface to engage a length of conduit as it is being bent, and a pair of ribs facing in opposite directions to engage each pair of grooves to selectively locate the stop surface relative to each pair of grooves;

wherein the bender head further comprises at least one structural web underlying the arcuate channel, and the angle setter further comprises an elongate channel configured to releasably receive a portion of the web to retain the angle setter in a stored position on the bender head; and wherein the elongate channel is defined between two spaced walls with one of the ribs formed on one of the walls and the other rib formed on the other wall, and the elongate channel and the stop surface are located on opposite faces of the angle setter.

2. The manual conduit bender of claim 1 wherein the angle setter has an interference fit with the bender head with the angle setter engaged at each of the plurality of positions.

3. The manual conduit bender of claim 2 wherein each rib is biased into engagement with the corresponding one of the grooves with the ribs engaged in one of the pair of grooves.

4. The manual conduit bender of claim 2 wherein the angle setter further comprises a pair of oppositely facing side surfaces that are sized to have an interference fit with inwardly facing surfaces in the arcuate channel of the bender head with the angle setter engaged at each of the plurality of positions.

5. The manual conduit bender of claim 1 wherein the angle setter further comprises indicia to allow a user to visually align the angle setter to provide proper location of the ribs with a desired pair of the grooves.

6. The manual conduit bender of claim 1 wherein each groove is defined by a concave, semicylindrical surface, and each rib is defined by a convex semicylindrical surface.

7. The manual conduit bender of claim 1 wherein the stop surface extends along a longitudinal axis and has a convex arcuate profile transverse to the longitudinal axis.

8. The manual conduit bender of claim 1 wherein the elongate channel extends along an axis that is coplanar with the longitudinal axis.

9. The manual conduit bender of claim 1 wherein each rib is formed on a side of the corresponding wall that faces away from the elongate channel.

10. The manual conduit bender of claim 1 wherein the angle setter further comprises a bottom surface that is shaped to conform to the arcuate channel, and the stop surface and the bottom surface are located on opposite faces of the angle setter.

11. The manual conduit bender of claim 1 wherein the angle setter comprises a one-piece, unitary body and the stop surface and the ribs are formed on the body.

12. The manual conduit bender of claim 1 further comprising an elongate handle extending from the head, the head is a one-piece, unitary component, and the handle is a separate component that is assembled to the head.

* * * * *